US009834881B2

(12) United States Patent
Sawford et al.

(10) Patent No.: US 9,834,881 B2
(45) Date of Patent: Dec. 5, 2017

(54) CLEANING APPARATUS

(71) Applicant: Xeros Limited, Rotherham (GB)

(72) Inventors: Michael David Sawford, Rotherham (GB); Wayne Robert Szymczyk, Rotherham (GB); Gareth Evan Lyn Jones, Bath (GB)

(73) Assignee: Xeros Limited, Rotherham (GB)

( * ) Notice: Subject to any disclaimer, the term of this patent is extended or adjusted under 35 U.S.C. 154(b) by 376 days.

(21) Appl. No.: 14/505,978

(22) Filed: Oct. 3, 2014

(65) Prior Publication Data

US 2015/0096129 A1 Apr. 9, 2015

(30) Foreign Application Priority Data

Oct. 3, 2013 (GB) ..... 1317558.3

(51) Int. Cl.
*D06F 39/08* (2006.01)

(52) U.S. Cl.
CPC ..... *D06F 39/088* (2013.01); *D06F 39/08* (2013.01); *D06F 39/081* (2013.01)

(58) Field of Classification Search
CPC ..... D06F 35/00; D06F 39/083; D06F 21/14; A47L 15/0094
See application file for complete search history.

(56) References Cited

U.S. PATENT DOCUMENTS 3,425,078 A * 2/1969 Lazaga ..... A47L 15/0002 15/3
4,801,333 A * 1/1989 Mosell ..... A47L 15/0002 134/186

(Continued)

FOREIGN PATENT DOCUMENTS

EP 0016895 A1 * 10/1980 ..... A47L 15/0002
EP 1832218 A1 9/2007

(Continued)

OTHER PUBLICATIONS

International Search Report in related PCT Application No. PCT/GB2014/052999 dated Dec. 16, 2014.

(Continued)

*Primary Examiner* — Joseph L Perrin
*Assistant Examiner* — Irina Graf
(74) *Attorney, Agent, or Firm* — Troutman Sanders LLP; Ryan A. Schneider

(57) ABSTRACT

An apparatus for cleaning a soiled substrate using solid particulate material having a cleaning volume; a collecting volume; a pumping device having a pump inlet; and a circulation pathway by which solid particulate material and a transporting fluid can be transferred from the collecting volume to the cleaning volume via said pumping device. The apparatus further includes a flow regulating device disposed in the collecting volume and comprising a flow through enclosure defined by at least one wall, an enclosure outlet in communication with the pump inlet, at least one particle inlet orifice disposed at an underside of the flow through enclosure and configured to admit both solid particulate material and transporting fluid to the enclosure. The apparatus can further include at least one relatively smaller fluid inlet orifice configured only to admit transporting fluid to the flow through enclosure.

20 Claims, 7 Drawing Sheets

(56) References Cited

U.S. PATENT DOCUMENTS

| | | | | | |
|---|---|---|---|---|---|
| 4,959,930 | A * | 10/1990 | Tsutsumi | ..... | A47L 15/0002 134/7 |
| 5,601,480 | A * | 2/1997 | Nilen | ..... | A47L 15/0002 451/88 |
| 5,735,730 | A * | 4/1998 | Jonemo | ..... | A47L 15/0094 134/109 |
| 6,280,301 | B1 | 8/2001 | Rogmark | | |
| 2012/0284931 | A1* | 11/2012 | Jenkins | ..... | D06F 23/025 8/137 |
| 2012/0304400 | A1* | 12/2012 | Jenkins | ..... | D06F 35/00 8/137 |

FOREIGN PATENT DOCUMENTS

| | | | | | |
|---|---|---|---|---|---|
| SE | GB 191408004 | A * | 6/1914 | ..... | A47L 15/04 |
| WO | 9960914 | A1 | 12/1999 | | |
| WO | 2010094959 | A1 | 8/2010 | | |
| WO | 2012035342 | A1 | 3/2012 | | |

OTHER PUBLICATIONS

Office Action issued by the European Patent Office for related European Patent Application No. 14781937.9 dated May 10, 2017.
Office Action issued by the State Intellectual Property Office of the People's Republic of China for related Chinese Patent Application No. 201480053633.7 dated Apr. 17, 2017.
English translation of Office Action issued by the State Intellectual Property Office of the People's Republic of China for related Chinese Patent Application No. 201480053633.7 dated Apr. 17, 2017.

* cited by examiner 10
10a
10b
10c
10d
10e
10f
12
14
16
18
20
22
24
28
28a
A
A
L

CLEANING APPARATUS

FIELD OF THE INVENTION

The present invention relates to a cleaning apparatus which employs a solid particulate material. In operation, the apparatus may require the use of only limited quantities of energy, water and detergent as compared with conventional cleaning apparatus, and in particular as compared with conventional washing machines. More particularly, the apparatus can provide an enhanced circulation of the solid particulate cleaning material and seeks to minimize occurrences of blockages which may be caused by accumulation of the solid particulate cleaning material.

BACKGROUND TO THE INVENTION

Aqueous cleaning processes are a mainstay of conventional domestic and industrial textile fabric cleaning methods. On the assumption that the desired level of cleaning is achieved, the efficacy of such conventional processes is usually characterized by their levels of consumption of energy, water and detergent. In general, the lower the requirements with regard to these three components, the more efficient the washing process is deemed. The downstream effect of reduced water and detergent consumption is also significant, as this minimizes the need for disposal of aqueous effluent, which is both extremely costly and detrimental to the environment.

Conventional washing processes involve aqueous submersion of fabrics followed by soil removal, aqueous soil suspension, and water rinsing. In general, within practical limits, the higher the level of energy (or temperature), water and detergent which is used, the better the cleaning. The key issue, however, concerns water consumption, as this sets the energy requirements (in order to heat the wash water), and the detergent dosage (to achieve the desired detergent concentration). In addition, the water usage level defines the mechanical action of the process on the fabric, which is another important performance parameter; this is the agitation of the cloth surface during washing, which plays a key role in releasing embedded soil. In aqueous processes, such mechanical action is provided by the water usage level in combination with the drum design for any particular washing machine. In general terms, it is found that the higher the water level in the drum, the better the mechanical action. Hence, there is a dichotomy created by the desire to improve overall process efficiency (i.e. reduce energy, water and detergent consumption), and the need for efficient mechanical action in the wash.

Various different approaches to the development of new cleaning technologies have been reported in the prior art, including methods which rely on electrolytic cleaning or plasma cleaning, in addition to approaches which are based on ozone technology, ultrasonic technology or steam technology. Thus, for example, WO2009/021919 teaches a fabric cleaning and disinfection process which utilizes UV-produced ozone along with plasma. An alternative technology involves cold water washing in the presence of specified enzymes, whilst a further approach which is particularly favored relies on air-wash technology and, for example, is disclosed in US2009/0090138. In addition, various carbon dioxide cleaning technologies have been developed, such as the methods using ester additives and dense phase gas treatments which are described in U.S. Pat. No. 7,481,893 and US2008/0223406, although such methods generally find greater applicability in the field of dry cleaning. Many of these technologies are, however, technically very complex.

In the light of the challenges which are associated with aqueous washing processes, the present applicant has previously devised a new approach to the problem that allows the deficiencies demonstrated by the methods of the prior art to be mitigated or overcome. The method which is provided may significantly reduce or eliminate the requirement for the use of large volumes of water, but is still capable of providing an efficient means of cleaning and stain removal from textile fabric substrates, whilst also yielding economic and environmental benefits.

Thus, in WO2007/128962 there is disclosed a method and formulation for cleaning a soiled substrate, the method comprising the treatment of the moistened substrate with a formulation comprising a multiplicity of polymeric particles, wherein the formulation is free of organic solvents. The substrate may be wetted so as to achieve a substrate to water ratio of between 1:0.1 to 1:5 w/w, and optionally, the formulation may additionally comprise at least one cleaning material, which typically comprises a surfactant, which most preferably has detergent properties. The substrate may comprise a textile fiber. The polymeric particles may, for example, comprise particles of polyamides, polyesters, polyalkenes, polyurethanes or their copolymers, a particular example being nylon beads.

The use of this cleaning method, however, presents a requirement for the polymeric particles (such as nylon beads) to be efficiently separated from the cleaned substrate at the conclusion of the cleaning operation, and this issue was initially addressed in WO2010/094959, which provides a novel design of cleaning apparatus requiring the use of two internal drums capable of independent rotation, and which finds application in both industrial and domestic cleaning processes.

With a view to providing a simpler, more economical means for addressing the problem of efficient separation of the cleaning beads (polymeric particles) from the substrate at the conclusion of the cleaning process, however, a further apparatus is disclosed in WO2011/064581. The apparatus of WO2011/064581, which finds application in both industrial and domestic cleaning processes, comprises a perforated drum and a removable outer drum skin which is adapted to prevent the ingress or egress of fluids and solid particulate matter (e.g. polymeric particles) from the interior of the drum. The cleaning method requires attachment of the outer skin to the drum during a first wash cycle, after which the skin is removed prior to operating a second wash cycle, following which the cleaned substrate is removed from the drum.

The apparatus and method of WO2011/064581 is found to be extremely effective in successfully cleaning substrates, but the requirement for the attachment and removal of the outer skin detracts from the overall efficiency of the process and the present applicant has, therefore, sought to address this aspect of the cleaning operation and to provide a process wherein this procedural step is no longer necessary. Thus, by providing for continuous circulation of the cleaning beads (solid particulate material, such as polymeric particles) during the cleaning process, it has been found possible to dispense with the requirement for the provision of an outer skin.

Thus, in WO2011/098815, the present applicant provided an apparatus for use in the cleaning of soiled substrates, the apparatus comprising housing means having a first upper chamber with a rotatably mounted cylindrical cage mounted therein and a second lower chamber located beneath the cylindrical cage, and additionally comprising at least one recirculation means, access means, pumping means and a multiplicity of delivery means, wherein the rotatably mounted cylindrical cage comprises a drum having perforated side walls where up to 60% of the surface area of the side walls comprises perforations comprising holes having a diameter of no greater than 25.0 mm.

The apparatus of WO2011/098815 is used for the cleaning of soiled substrates by means of methods which comprise the treatment of the substrates with formulations comprising solid particulate cleaning material and wash water, the methods typically comprising the steps of:

(a) introducing solid particulate cleaning material and water into the lower chamber of the apparatus;
(b) agitating and heating the solid particulate cleaning material and water;
(c) loading at least one soiled substrate into the rotatably mounted cylindrical cage via the access means;
(d) closing the access means so as to provide a substantially sealed system;
(e) introducing the solid particulate cleaning material and water into the rotatably mounted cylindrical cage;
(f) operating the apparatus for a wash cycle, wherein the rotatably mounted cylindrical cage is caused to rotate and wherein fluids and solid particulate cleaning material are caused to fall through perforations in the rotatably mounted cylindrical cage into the lower chamber in a controlled manner;
(g) operating the pumping means so as to transfer fresh solid particulate cleaning material and recycle used solid particulate cleaning material to separating means;
(h) operating control means so as to add the fresh and recycled solid particulate cleaning material to the rotatably mounted cylindrical cage in a controlled manner; and
(i) continuing with steps (f), (g) and (h) as required to effect cleaning of the soiled substrate.

As outlined above, the apparatus of WO2011/098815 therefore includes features to introduce solid particulate cleaning material into the rotatably mounted cylindrical cage and also comprises at least one recirculation means to facilitate recirculation of said solid particulate material for its re-use in cleaning operations. In addition, the apparatus of WO2011/098815 can include ducting comprising separating means for separating the solid particulate material from water and control means adapted to control entry of the solid particulate material into the cylindrical cage. In one disclosed embodiment, the separating means comprises a rigid filter material such as wire mesh located in a receptor vessel above the cylindrical cage, and the control means comprises a valve located in feeder means, preferably in the form of a feed tube attached to the receptor vessel, and connected to the cage.

Although the apparatus disclosed in WO2011/098815 provided considerable improvements for the cleaning of soiled substrates with formulations comprising solid particulate cleaning material and wash water, there remain several drawbacks.

One problem which may occur is an accumulation of solid particulate material within a pumping device used for the circulation of the solid particulate material. Such accumulation can potentially render the pumping device inoperative until such accumulation is removed, which may require the intervention of a skilled operative.

In particular, the pumping device of the prior art may be located in, or in direct communication with, a lowermost part of a collecting space for the solid particulate material, such as a sump. The collecting space is configured to collect the solid particulate material at certain stages of, or times in, the wash process when such solid particulate material is not needed in the cylindrical cage. The collecting space is configured so that a mass or body of the solid particulate material may accumulate at the lowermost part thereof. When required for use, the solid particulate material is transferred from the collecting space by a pumping means. However, the solid particulate material may enter the pumping device and form a mass or body therein. The formation of such mass or body within the pumping device may be encouraged by the vibrations of the apparatus which occur during the cleaning cycle. Such vibrations encourage entry of the solid particulate material into the pumping device, notably when the pumping device is not in operation and can further encourage some compaction of the mass of solid particulate material within the pumping device. The compacted mass of solid particulate material can prevent the pumping device form starting when required. Effectively, a blockage in the pumping device is formed which must be displaced, such as by operator intervention, before the pumping device can be started for transferring the solid particulate material from the collecting space.

It has further been observed in apparatus of the prior art that variations in relative amounts of solid particulate material and liquid (water or water and detergent for example) exiting the pumping device can occur. This means that a desired ratio of solid particulate material and liquid in the cleaning volume might not be achieved, for optimization of the cleaning procedure. The inventors have appreciated that such variations may be attributable to factors such as the quantity of fluid in the collecting volume at any given time and the volume and density of packing of the solid particulate material in the collecting volume (at least in proximity to the pumping device) at any given time.

In some embodiments, the present disclosure seeks to provide a cleaning apparatus for use in the cleaning of soiled substrates with a solid particulate material that can ameliorate or overcome above-noted problems associated with the prior art.

Particularly, there is desired an apparatus and method for the cleaning of soiled substrates which can alleviate problems associated with the accumulation of solid particulate material in, or in proximity to, a pumping device used for circulation of the solid particulate material.

Also there is desired an apparatus and method for cleaning substrates in which a substantially constant ratio of solid particulate material and fluid exiting the pumping device can be achieved.

SUMMARY OF THE INVENTION

According to a first aspect of the present invention there is provided an apparatus for cleaning a soiled substrate using solid particulate material, the apparatus comprising a cleaning volume;

a collecting volume;

a pumping device having a pump inlet;

a circulation pathway by which solid particulate material and a transporting fluid can be transferred from the collecting volume to the cleaning volume via said pumping device;

the apparatus further comprising a flow regulating device disposed in the collecting volume and comprising a flow through enclosure defined by at least one wall, an enclosure outlet in communication with the pump inlet, at least one particle inlet orifice disposed at an underside of the enclosure and configured to admit both solid particulate material and transporting fluid to the enclosure and an enclosure roof portion of the at least one wall through which solid particulate material cannot be admitted to the enclosure.

In some preferred embodiments of the first aspect of the invention the enclosure roof portion can extend over at least the whole width and length of the flow through enclosure.

In some preferred embodiments of the first aspect of the invention the enclosure roof portion can include one or more fluid inlet orifices configured only to admit transporting fluid to the enclosure.

In some preferred embodiments of the first aspect of the invention the apparatus can be a commercial washing machine.

In some preferred embodiments of the first aspect of the invention the apparatus can be a domestic washing machine. A domestic washing machine is a washing machine configured for location in a private dwelling such as a house or apartment.

In some preferred embodiments of the first aspect of the invention the collecting volume can be arranged below the cleaning volume.

In some preferred embodiments of the first aspect of the invention the cleaning volume can comprise a perforate drum configured for rotation. Preferably the drum is configured for rotation about a substantially horizontal axis.

In some preferred embodiments of the first aspect of the invention the collecting volume can be arranged directly below the perforate drum.

In some preferred embodiments of the first aspect of the invention the collecting volume can include a collecting region at a lowermost portion thereof proximate the pumping device in which collecting region the solid particulate material can accumulate and wherein the flow regulating device is arranged in the collecting region.

In some preferred embodiments of the first aspect of the invention said collecting volume can comprise at least one inclined wall configured to direct the solid particulate material to the collecting region of the collecting volume.

In some preferred embodiments of the first aspect of the invention the at least one wall defining the flow through enclosure can include at least one inclined wall or wall portion arranged in juxtaposition to and parallel to a said at least one inclined wall of the collecting volume, the inclined wall of the flow through enclosure including at least one particle inlet orifice.

In some preferred embodiments of the first aspect of the invention the flow regulating device can comprise at least one relatively smaller fluid inlet orifice configured only to admit transporting fluid to the flow through enclosure and at least one relatively larger particle inlet orifice disposed at an underside of the flow through enclosure and configured to admit both solid particulate material and transporting fluid to the flow through enclosure.

In some preferred embodiments of the first aspect of the invention the flow regulating device can comprise an end wall arranged opposite the enclosure outlet, at least one fluid inlet orifice being formed in said end wall such that transporting fluid passing through the at least one fluid inlet orifice has a substantially linear flow path from the at least one fluid inlet to the enclosure outlet. In other embodiments, one or more fluid inlet orifices may (alternatively or additionally) be formed in an upper part of said at least one wall defining the enclosure.

In some preferred embodiments of the first aspect of the invention at least one particle inlet has a length which is greater than its width.

In some preferred embodiments of the first aspect of the invention the apparatus can comprise at least two particle inlets.

In some preferred embodiments of the first aspect of the invention the apparatus can comprise at least four particle inlets.

In some preferred embodiments of the first aspect of the invention the flow regulating device (more especially the flow through enclosure thereof) may be substantially cylindrical. Other configurations are possible such as shapes which are generally hexagonal, octagonal or other polyhedral in section, and shapes which are oval in section, for example.

In some preferred embodiments of the first aspect of the invention the solid particulate material can be a polymeric material.

In some preferred embodiments of the first aspect of the invention the transporting fluid can be an aqueous fluid, in particular, water.

In some preferred embodiments of the first aspect of the invention the transporting fluid can be washing liquor.

In some preferred embodiments of the first aspect of the invention the soiled substrate is a textile material, in particular one or more garments or domestic or hotel linens such as, bed linen, towels, napery or the like.

According to a second aspect of the invention there is provided an apparatus for cleaning a soiled substrate using solid particulate material, the apparatus comprising a cleaning volume;

a collecting volume;

a pumping device having a pump inlet;

a circulation pathway by which solid particulate material and a transporting fluid can be transferred from the collecting volume to the cleaning volume via said pumping device;

the apparatus further comprising a flow regulating device disposed in the collecting volume and comprising a chamber defined by at least one wall, a chamber outlet in communication with the pump inlet, at least one relatively smaller first inlet orifice configured only to admit transporting fluid to the chamber and at least one relatively larger second inlet orifice disposed at an underside of the chamber and configured to admit both solid particulate material and transporting fluid to the chamber.

In some preferred embodiments of the second aspect of the invention the at least one wall defining the chamber can include an enclosure roof portion.

In some preferred embodiments of the second aspect of the invention the apparatus can be a commercial washing machine or a domestic washing machine.

In some preferred embodiments of the second aspect of the invention the collecting volume can be arranged below the cleaning volume.

In some preferred embodiments of the second aspect of the invention the cleaning volume can comprise a perforate drum configured for rotation about a substantially horizontal axis.

In some preferred embodiments of the second aspect of the invention the collecting volume can be arranged directly below the perforate drum.

In some preferred embodiments of the second aspect of the invention said collecting volume can comprise at least one inclined wall configured to direct the solid particulate material to a collecting region of the collecting volume proximate the pumping device, the flow regulating device being disposed in said collecting region.

In some preferred embodiments of the second aspect of the invention the flow regulating device can comprise an end wall arranged opposite the chamber outlet, the at least one first inlet being formed in said end wall such that transporting fluid passing through the at least one first inlet has a substantially linear flow path from the at least one first inlet to the chamber outlet.

In some preferred embodiments of the second aspect of the invention the, or each, at least one second inlet can have a length which is greater than its width.

In some preferred embodiments of the second aspect of the invention the apparatus can comprise at least two second inlets.

In some preferred embodiments of the second aspect of the invention the apparatus can comprise at least four second inlets.

In some preferred embodiments of the second aspect of the invention the flow regulating device can be substantially cylindrical.

In some preferred embodiments of the second aspect of the invention the solid particulate material can be a polymeric material.

In some preferred embodiments of the second aspect of the invention the transporting fluid can be water.

In some preferred embodiments of the second aspect of the invention the transporting fluid can be washing liquor.

In some preferred embodiments of the second aspect of the invention the soiled substrate can be a textile material, in particular one or more garments, linens, napery, towels or the like.

In the embodiments mentioned hereinafter, in relation to the second aspect of the invention, references to "enclosure" or "flow through enclosure" can be taken as reference to the chamber. Similarly, references to the "particle inlet orifice" can be taken as reference to the second inlet orifice and reference to the "fluid inlet orifice" can be taken as references to the first inlet orifice of the second aspect of the invention.

As used herein that wording such as "in some embodiments or "in preferred embodiments" applies to all aspects of the present invention unless stated to the contrary, or unless context requires that the embodiment is only directed to only one or only some aspects. In some preferred embodiments, the at least one fluid inlet orifice may be in the form of a reticulate structure, such as a mesh or net. In some such embodiments, the reticulate structure may form substantially all of, or a substantial part, of said end wall of the flow through enclosure.

In some preferred embodiments equal number of particle inlet orifices may be provided on respective sides of a nominally vertical plane bisecting the flow through enclosure through its longitudinal axis. In some embodiments the pumping device can be configured to pump said solid particulate material and transporting fluid upwardly from the collecting volume to a door, the door providing a closeable access to the cleaning volume from the apparatus exterior. The solid particulate material can pass through the door, or a component thereof, to enter the cleaning volume. A portion of the transporting fluid can enter the cleaning volume with the solid particulate material.

In some embodiments a separator disposed in the door can be arranged to receive an upward flow of said solid particulate material and transporting fluid along the circulation pathway from said collecting volume and said separator can be further arranged to direct the solid particulate material into the cleaning volume (specifically into the drum) from said upward flow.

In some embodiments said collecting volume can comprise a sump.

In some advantageous embodiments pumping the cleaning mixture (solid particulate material and transporting fluid) upwardly to the door can facilitate a shorter transport path for the solid particulate material from the collecting volume to the cleaning volume, thereby improving the efficiency of the cleaning apparatus.

In some embodiments the cleaning apparatus can further comprise a tub wherein said cleaning volume (in particular, the drum) is mounted within the tub.

In some embodiments said door can be mounted to a portion of the tub.

In some embodiments the tub and the collecting volume (specifically, the sump) can be unitary. In some advantageous embodiments the provision of an integrated tub and sump can facilitate transport of the solid particulate material and the transporting fluid from the sump to the cleaning volume, in particular via the door.

In some embodiments said drum can have a capacity in the region of 10 to 7000 liters. In certain embodiments said drum can have a capacity in the region of 10 to 700 liters. In further embodiments said drum can have a capacity in the region of 30 to 150 liters.

The solid particulate material can also referred to as a multiplicity of solid particles. For the avoidance of doubt, the solid particulate material is distinguished from, and should not be construed as being, a conventional washing powder (that is laundry detergent in powder form). Washing powder is generally soluble in the wash water and is included primarily for its detergent qualities. The washing powder is disposed of during the wash cycle since it is sent to drain in grey water along with removed soil. In contrast, a significant function of the solid particulate material referred to herein is a mechanical action on the substrate which enhances cleaning of the substrate. In preferred embodiments, the solid particulate material is retained within the apparatus of the invention and is used in a plurality of cleaning procedures.

In some embodiments the multiplicity of solid particles can comprise or can consist of a multiplicity of polymeric particles.

In some embodiments the multiplicity of solid particles can comprise or can consist of a multiplicity of non-polymeric particles.

In some embodiments the multiplicity of solid particles can comprise or can consist of a mixture of polymeric solid particles and non-polymeric solid particles.

In some embodiments the polymeric particles can be selected from particles of polyalkenes, polyamides, polyesters, polysiloxanes, polyurethanes or copolymers thereof.

In some embodiments the polymeric particles can comprise particles selected from particles of polyalkenes or copolymers thereof.

In some embodiments the polymeric particles can comprise particles of polyamide or polyester or copolymers thereof.

In some embodiments the polyester particles can comprise particles of polyethylene terephthalate or polybutylene terephthalate.

In some embodiments the polyamide particles can comprise particles of nylon. In further embodiments said nylon can comprise Nylon 6 or Nylon 6,6.

In some embodiments the non-polymeric particles can comprise particles of glass, silica, stone, wood, metals or ceramic materials.

In some embodiments the multiplicity of solid particles can be in the form of multiplicity of beads.

In some embodiments the solid particles can be reused one or more times for treatment of substrates in, with or by the apparatus of the invention.

In some embodiments the wash liquor can be water. In some embodiments the wash liquor can be an aqueous medium. In some embodiments the wash liquor can comprise at least one detergent or detergent composition. The wash liquor can comprise one or more additives as detailed further hereinbelow. Thus, in some embodiments the wash liquor can comprise post-treatment components, optionally in addition to said detergent composition. In some embodiments said wash liquor can comprise cleaning components selected from the group consisting of: surfactants, enzymes and bleach. In some embodiments said post-treatment components can be selected from the group consisting of: anti-redeposition additives, perfumes and optical brighteners.

In some embodiments the wash liquor can comprise at least one additive selected from the group consisting of: builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and pigments.

The composition of the wash liquor may depend at any given time on the point which has been reached in the cleaning cycle for the soiled substrate using the apparatus of the invention. Thus, for example, at the start of the cleaning cycle, the wash liquor may be water. At later point in the cleaning cycle the wash liquor may include detergent and/or one of more of the above mentioned additives. During a cleaning stage of the cleaning cycle, the wash liquor may include suspended soil removed from the substrate.

In some cleaning processes using the apparatus of the invention, it may be advantageous to introduce wash liquor to the cleaning volume without the solid particulate material. An alternative route for addition to the cleaning volume of wash liquor other than via the collecting volume and its pumping device can be provided. In other words, the wash liquor need not act as a transporting fluid for every addition of wash liquor to the cleaning volume.

In some embodiments during a cleaning process with the apparatus of the invention a ratio within the cleaning volume of wash liquor to substrate being cleaned can be about 5:1 to 0.1:1 w/w.

In some embodiments the ratio of said multiplicity of solid particles (solid particulate material) to substrate being cleaned can be in the range of from about 0.1:1 to about 30:1 w/w.

According to a third aspect of the invention there is provided a method for cleaning a soiled substrate comprising the treatment in an apparatus according to any preceding claim of the substrate with a formulation comprising said solid particulate material and a wash liquor.

In some preferred embodiments the method can comprising circulating the solid particulate material from the collecting volume to the cleaning volume along the circulating path.

BRIEF DESCRIPTION OF THE DRAWINGS

For a better understanding of the invention and to show how the same may be carried into effect, reference will be made, by way of example only, to the following drawings, in which:—

DETAILED DESCRIPTION OF THE INVENTION

The present applicant has addressed the issues associated with using a cleaning apparatus to clean soiled substrates with a solid particulate material and particularly the problems associated with the need to efficiently transfer the solid particulate material from a collecting region, such as a sump, to a cleaning or washing region, such as a cylindrical cage or drum.

Figures 1, 2, 3:
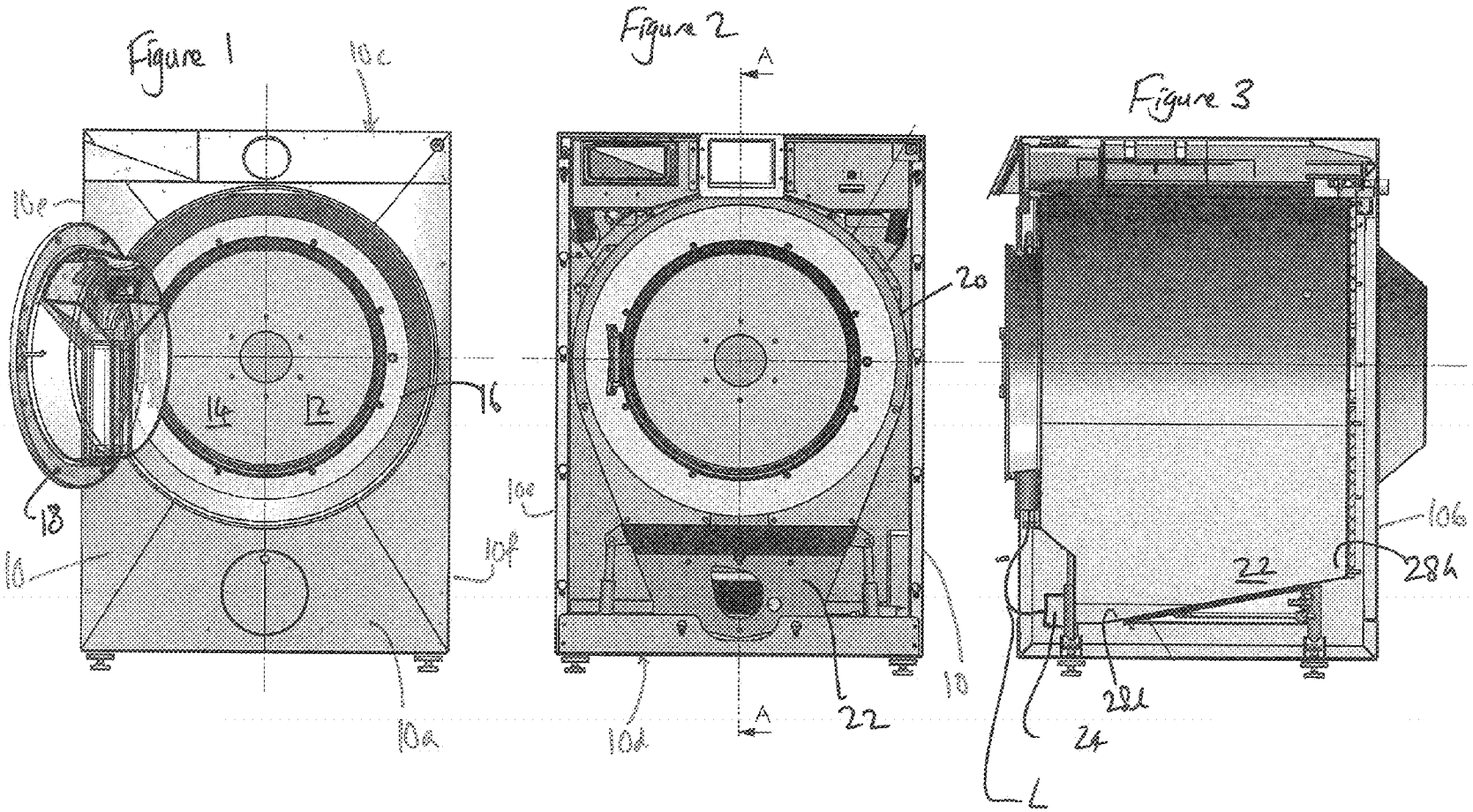
FIG. 1 is a front view of one embodiment of an apparatus according to the present invention.
FIG. 2 is a view of the apparatus of FIG. 1 with the front housing part removed.
FIG. 3 is a section on the line A-A of FIG. 2.

Referring now to the drawings, an apparatus 100 according to embodiments of the invention typically comprises an external housing or casing 10 which may comprise a front face 10*a*, rear face 10*b*, top face 10*c*, bottom face 10*d* and side faces 10*e*, 10*f*. FIG. 2 shows an apparatus of the invention with front face 10*a* of external housing 10 removed.

The apparatus 100 can further include a perforate drum or cage 12 defining a cleaning volume. In use of the apparatus 100 the drum 12 contains the substrate(s) being cleaned. The drum 12 may preferably be mounted for rotation about a horizontal axis and the substrate being cleaned is brought into contact with solid particulate material, water and such other cleaning additives as may be desirable within the drum 12.

The drum 12 has an opening 14 through which the substrate(s) to be cleaned can be loaded into the drum 12 and through which the cleaned substrate(s) can be removed after the cleaning process. The opening 12 is arranged at the front side of the apparatus and a corresponding opening 16 is formed in the front face 10*a* of the external housing 10. In use of the apparatus 100, the drum opening 14 is closed by a door 18. The door 18 may conveniently be hingedly mounted for movement between open and closed configurations. Apparatus 100 may further comprise an internal housing or tub 20 which surrounds the drum 12 and which (when the door 18 is in its closed position) forms a fluid tight space around the drum 12.

A collecting volume or sump 22 may be provided in which the solid particulate material (or portions thereof) may accumulate at times during the cleaning cycle using the apparatus 100. The solid particulate material may accumulate in the collecting volume 22 after leaving the cleaning volume (drum 12).

In some preferred embodiments, the collecting volume 22 may be provided in conjunction with the tub 20. The sump 22 may be located below the drum 12 so that wash liquor may drain naturally into the sump 22, that is, without the intervention of any pump or the like. Similarly it is preferred in some embodiments that the sump 22 is located below the drum 12 so that the solid particulate material which exits the drum 12 during use of the cleaning apparatus may pass into the sump 22 under the influence of gravity. In some preferred forms of the apparatus 100, the sump 22 is arranged directly beneath the drum 12. In some preferred embodiments the sump 22 may be formed integrally with the tub 12. Thus the tub 20, the sump 22 and the door 18 (in its closed position) form a closed space within which the particulate material and wash liquor may be confined during the cleaning process.

A circulation pathway can be provided for the transfer of solid particulate material and wash liquor from the sump 22 to the drum 12. The circulation pathway may include a pumping device 24 and appropriate pipework or tubing for conveying the solid particulate material and the transporting fluid. The apparatus 100 may be provided with one or more dosing means by which water and one or more cleaning agents (such detergent and/or other additives as noted herein) may be added to the cleaning volume (in particular to the drum 12) and one or more drain means by which water wash liquor (e.g. soil-bearing wash liquor) may be drained from the apparatus 100.

Pumping device 24 is shown schematically in FIG. 3. The pumping device 24 is preferably located, as shown in FIG. 3, proximate the front of the apparatus 100 (such as directly behind housing front face 10*a*) and also at a relatively low position close to housing bottom face 10*d*. A flow path (shown schematically as line L) extends from the pumping device 24 to the drum 12. In the illustrated embodiment, and advantageously, the flow path extends via door 18. Thus the pumping device 24 and the flow path (line L) are constituents of the circulation pathway.

Figure 4:
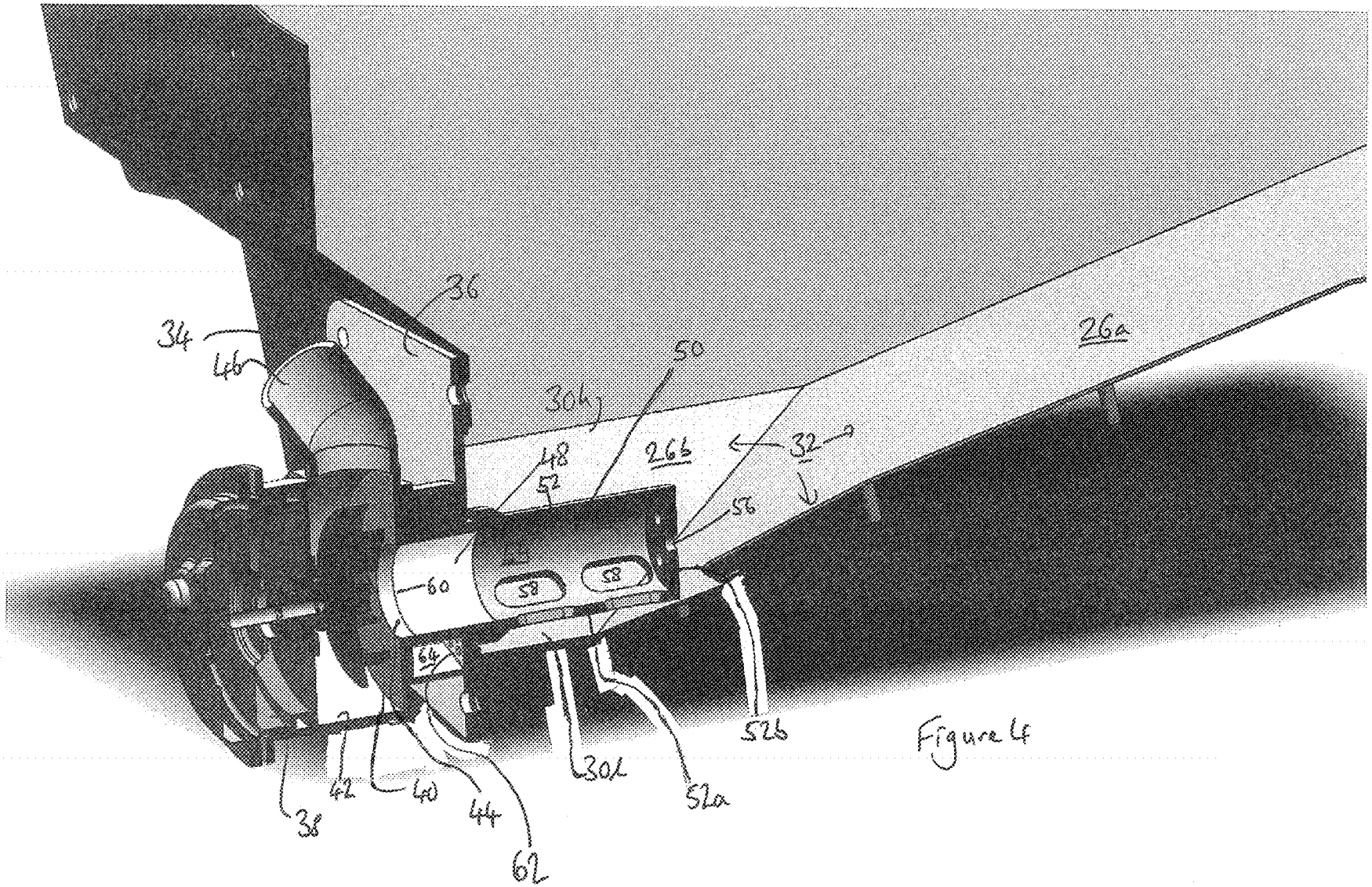
FIG. 4 is a section through a part of an apparatus according to the invention showing a collecting volume, a flow regulating device and a pumping device.
Figure 6:
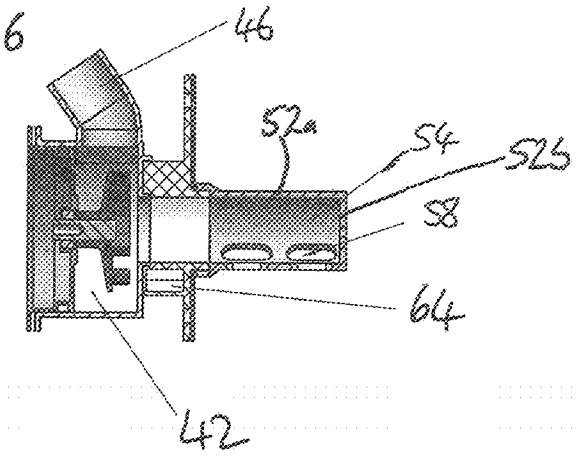
FIG. 6 is a section along the line of X-X of FIG. 5.
Figure 8:
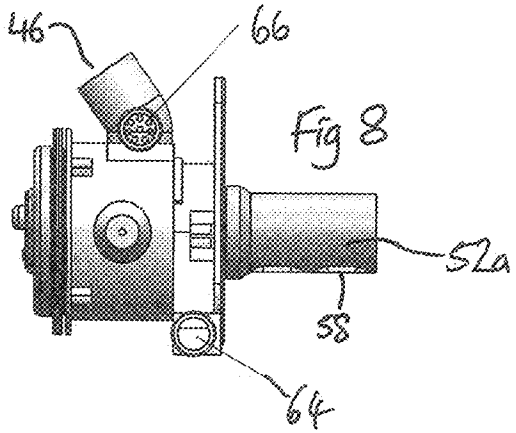
FIG. 8 is a side view of a pumping device and flow regulating device suitable for and with an apparatus according to the invention.

As can be seen in particular in the embodiments shown in FIGS. 3 and 4 sump 22 includes wall (or floor) members 26*a* and 26*b*. The wall members 26*a*, 26*b* are inclined. Wall member 26*a* slopes downwardly from a highest region 28*h* located towards the rear of the apparatus 100 to a lowest region 28*l* located towards the front of apparatus 100, proximate the pumping device 24. Wall member 26*b* slopes downwardly from a highest region 30*h* nearer to side face 10*e* of housing 10 to a lowest region 30*l* proximate the pumping device 24. A corresponding wall (not shown) is formed opposite wall 26*b* so that the three walls 26*a*, 26*b* and the corresponding wall form an inclined floor 32 of sump 22.

In use of the apparatus 100, solid particulate material exiting drum 12 falls to inclined floor 32. The inclined construction of floor 32 directs the solid particulate material towards the lowest part of the sump 22, that is, to the collecting region proximate the pumping device 24. Constructions for the inclined floor 32 which differ from that illustrated may be suitable, provided that in use the solid particulate material is encouraged to move towards a lowest part of the sump 22 proximate the pumping device 24.

It may be noted that, in operation of the apparatus 100, the sump 22, and specifically the floor 32 may be subject to vibration. This vibration may occur, for example, when the drum 12 is rotating, notably when the drum 12 is spinning at relatively high speed, such as for removal of wash liquor from the substrate being cleaned. Such vibration can further assist in directing the solid particulate material downwardly across the inclined floor 32 towards the lowest part of the sump 22.

It is apparent, therefore, that in operation of the apparatus 100 a mass or body of solid particulate material may be formed in the lowest part of the sump 22 as the solid particulate material moves towards said lowest part. "Mass or body" is not intended to imply any connection, attraction, bonding or other union between individual particles, but merely that the particles accumulate together in the same region.

Generally during a washing procedure, some wash liquor is also present in the sump 22. The amount of wash liquor (and hence the relative amounts of wash liquor and solid particulate material) may be regulated by means described in more detail below. In some circumstances, such as the very end or the beginning of a cleaning procedure, wash liquor may be substantially absent from the sump 22.

During a substrate cleaning procedure using the apparatus 100, solid particulate material is transferred from the sump 22 to the drum 12. To this end the pumping device 24 and circulation pathway (via line L) are provided. For such transfer of the solid particulate material, the solid particulate material is in mixture with the transporting fluid, which is preferably the wash liquor. Thus, pumping device 24 pumps the mixture of wash liquor and solid particulate material from the sump 22 to the drum 12. The solid particulate material may be pumped by the pumping device 24 into the drum 12 either continuously or at intervals, depending on factors such as the substrate being cleaned and the particular cleaning process or cycle which a user may select. The rate at which the solid particulate material is pumped by the pumping device 24 may also be varied, for example in accordance with a predetermined cleaning cycle or procedures.

In advantageous embodiments, the flow path of the solid particulate material from the pumping device 24 to the drum 12 is made as short as possible. Thus advantageously the flow path extends directly from the pumping device 24 to the drum 12. In advantageous constructions, the flow path extends directly from the pumping device 24 to the drum 12 via the door 18. In this construction, the door 18 is configured for passage therethrough of the solid particulate material (with the door 18 in its closed position) and provides a convenient and effective point of entry for the solid particulate material into the drum 12 via the opening 14 thereof.

Door 18 may usefully include a separator device by means of which transporting fluid is separated from the solid particulate material before the solid particulate material enters the drum 12. Separated transporting fluid may be returned to the sump 22.

In other embodiments, such as in relation to commercial laundry machines where space within the housing 100 is far less constrained (as compared with domestic washing machines) a separate storage chamber for the solid particulate material and/or a separate device for separating transporting fluid from the solid particulate material may be located at an upper part of the housing 100, such as at a level higher than the rotational axis of the drum 12. In this case, the solid material may flow from the storage chamber and/or separator to the drum 12 under the action of gravity, or under the action of a second pumping means. In these embodiments, the flow path of the solid particulate material from the pumping device 24 to the drum 12 is necessarily longer and/or less direct, but other advantages may accrue, such as simplicity of construction of the apparatus. Nevertheless a short, direct flow path from the pumping device 24 to the drum 12 is preferred, more especially where the apparatus 100 is a domestic washing machine.

As noted, pumping device 24 operates to transfer solid particulate material and the transporting fluid from the sump 22 to the drum 12. To this end, the sump 22 may be provided with a front wall 34 on which a pump housing 36 may be mounted. Front wall 34 can conveniently be a substantially vertical wall. The pump housing 36 is configured to contain the operational parts of the pumping device 24, such as an electric motor (not shown), a motor housing 38, and an impeller chamber 42. Elements of the pumping device 24 such as the motor and the impeller may be of conventional construction known to those of skill in the art and need not be described further. The pump housing 36 may be specifically configured for the apparatus 100. The pump housing 36 may further comprise a pump inlet 44 in direct communication with the impeller chamber 42 and a pump outlet 46 through which solid particulate material and transporting fluid is directed along the circulation pathway via line L to the drum 12. Front wall 36 of sump 22 may include an aperture 48 which is aligned and in fluid communication with the pump inlet 44.

As noted above, a mass of the solid particulate material may, in operation of the apparatus 100, form at the lowest portion of the sump 22 (that is, the collecting region), generally adjacent the pump inlet. A problem which has occurred in prior art apparatus is that, following operation of a pumping device for transferring the solid particulate material and the transporting material, a mass of the solid particulate material may also form in the impeller chamber of pumping device 24 (such as when the impeller is slowing down or stationary). The so-formed mass of solid particulate material in the impeller chamber may be such as to prevent movement of the impeller 40. The impeller 40 in effect becomes jammed and the pumping device 24 cannot be re-started until remedial action has been taken. Embodiments of the invention are directed to obviating or alleviating this problem. In particular, embodiments of the invention are directed to reducing, minimizing or preventing a build-up of solid particulate material in the impeller chamber 42 which may resist or prevent rotation of the impeller.

In embodiments of the invention, the apparatus 100 further comprises a flow regulating device 50, 150. The flow regulating device 50, 150 can take various constructional forms. In each constructional form the flow regulating device 50, 150 comprises at least one wall 52, 152 defining a flow through enclosure or chamber 54, 154. A portion 53, 153 of the said wall 52, 152 defines an enclosure roof portion through which solid particulate material cannot pass to enter the flow through enclosure 54, 154. The enclosure roof portion 53, 153 can include one or more fluid inlet apertures which permit the passage of fluid into the flow through enclosure.

Figure 13:
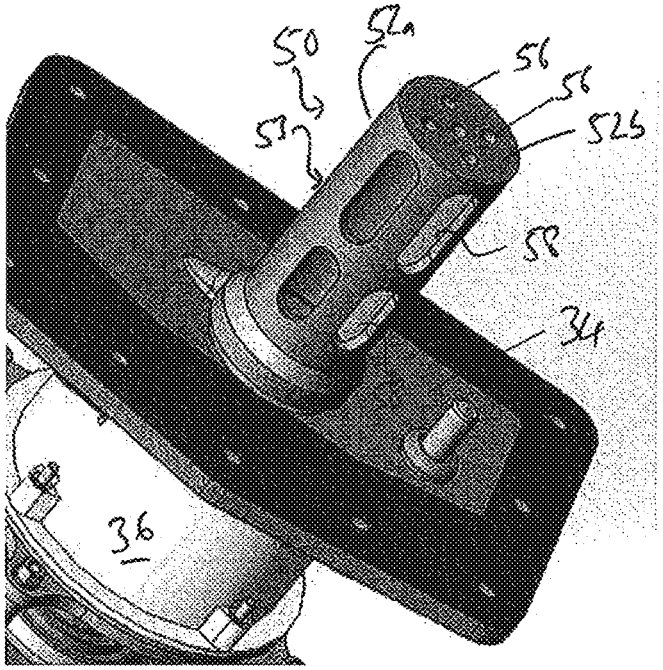
FIGS. 13 and 14 are perspective views of embodiments of a flow regulating device similar to those of FIGS. 4 to 8, mounted to a front wall of a collecting volume and a pump housing.
Figure 14:
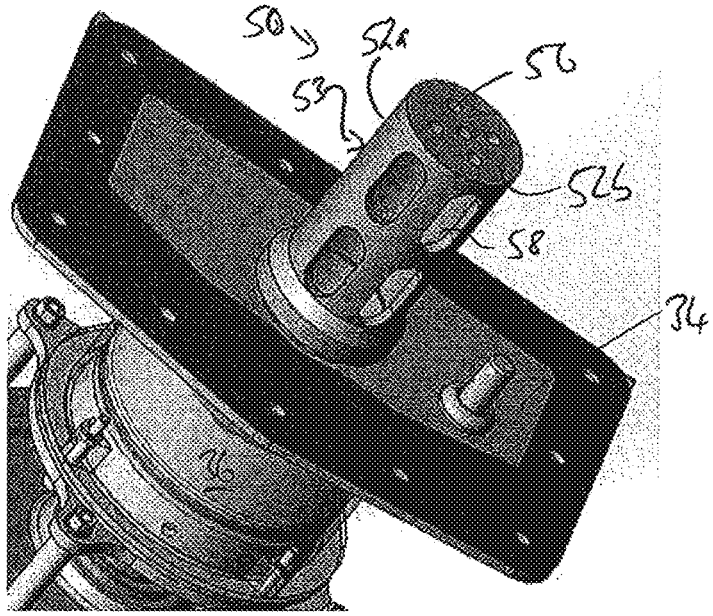
Figure 15:
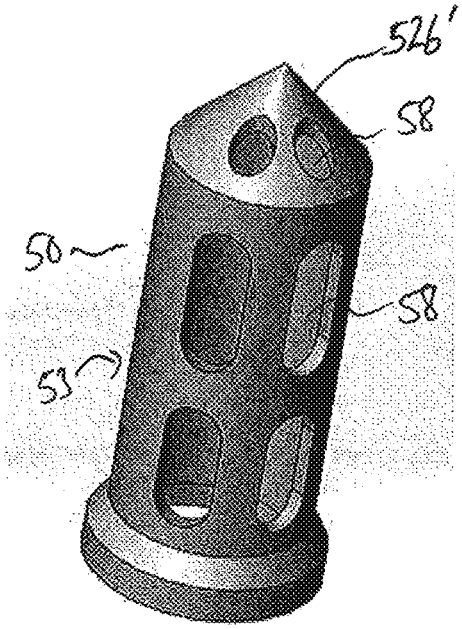
FIG. 15 shows a flow regulating device according to a yet further embodiment of the invention.

In the embodiment illustrated in FIGS. 4 to 8, 10, 11 and 13 to 15, the flow regulating device is generally cylindrical and includes a cylinder wall 52*a* and a cylinder end wall 52*b* (52*b*' in FIG. 15). The cylinder end wall 52*b* can include at least one relatively smaller fluid inlet orifice 56 (FIGS. 4, 6, 7, 13, 14). The cylinder wall 52*a* includes at least one particle inlet orifice 58. Where both the fluid inlet orifice 56 and the particle inlet orifice 58 are present, the, or each, particle inlet orifice 58 is larger than the, or each, fluid inlet orifice 56.

The end of the flow regulating device proximate the pumping device 24 and wall 34 (opposite the fluid inlet orifice(s), opposite cylinder end was 52*b* in FIGS. 4, 6, 7, 13 and 14)) is open and forms an enclosure outlet 60 which communicates directly with the pump inlet 44.

Figure 10:
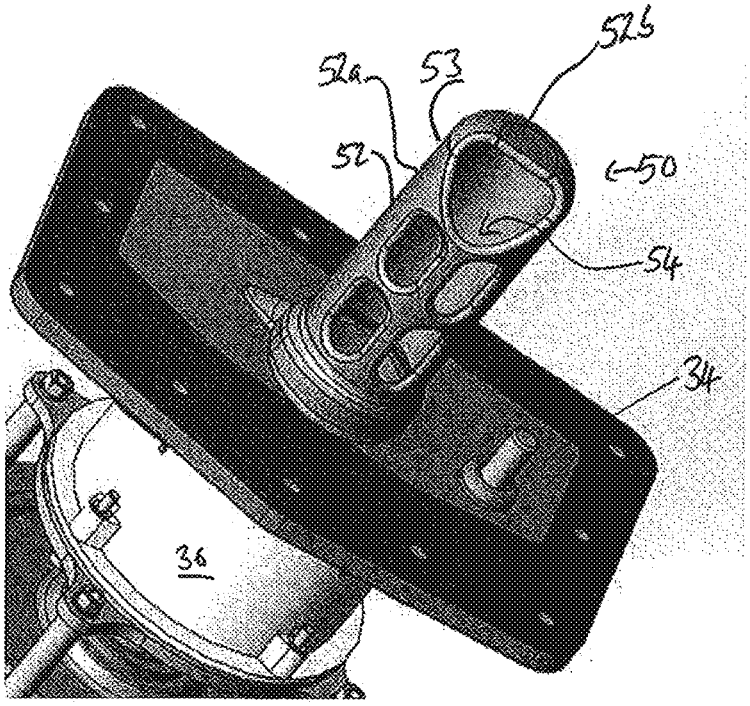
FIG. 10 is a perspective view of one embodiment of a flow regulating device mounted to a front wall of a collecting volume and a pump housing.
Figure 11:
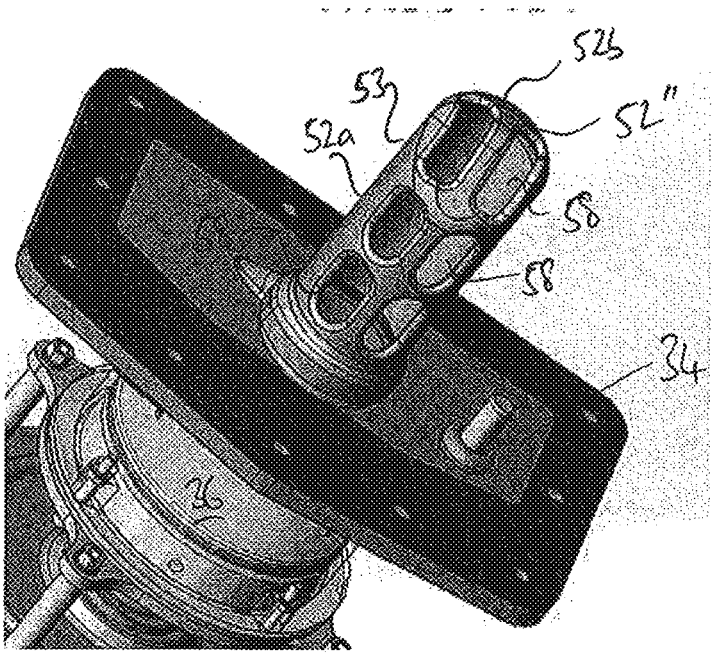
FIG. 11 is a perspective view of another embodiment of a flow regulating device mounted to a front wall of a collecting volume and a pump housing.

In the embodiments illustrated in FIGS. 10 and 11, there is no fluid inlet orifice 56. All the wash liquor and solid particulate material entering the flow through enclosure 54 passes through particle inlet orifices 58. In the embodiment of FIG. 10, five particle inlet orifices are provided and in the embodiment of FIG. 11 six particle inlet orifices 58 are provided. It can be noted that none of the particle inlet orifices 58 extends significantly above a horizontal bisector of the flow regulating device. In practice, the enclosure roof portion 53 can extend from an uppermost part of the flow regulating device 50 to uppermost edges of the particle inlet orifices 58. In the embodiment illustrated in FIG. 11, end wall 52*b* includes an inclined portion 52*b*" in which at least part of the particle inlet orifices are defined. The inclined portion can have an angle of inclination such that it lies parallel to a confronting inclined wall portion of the collecting volume, in particular a portion of wall 26*a*.

In the embodiment of FIG. 15, the construction of the flow regulating device is broadly similar to that of FIGS. 10 and 11, except that the end wall 52*b*' is of generally conical shape. End wall 52*b*' includes at least one (as illustrated, two) particle inlet orifices. A plurality (specifically four) of particle inlet orifices 58 .are provided in cylinder wall 52*a*. The respective particle inlet orifices 58 are arranged below the horizontal bisector of the flow regulating device 50, with the enclosure roof portion 53 extending therabove. In variations, one or more fluid inlet orifices 56 can be provided in end wall 52*b*' in addition to, or in the alternative to, the particle inlet orifices 58.

The embodiments of FIGS. 13 and 14 include a substantially cylindrical flow regulating device 50 defined by a cylindrical wall 52*a* and a generally planar end wall 52*b*. Particle inlet orifices 58 are formed in a lower portion of the cylindrical wall 52*a*, with the enclosure roof portion, through which solid particulate material cannot pass, extending thereabove. End wall 52*b* includes a plurality of fluid inlet orifices 56. The longitudinal extent of the flow regulating device of FIG. 13 is greater than that of the device of FIG. 14, illustrating the more general point that the size and shape of the flow regulating device can be tailored to the parameters and characteristics of the apparatus in which it is located.

Figure 12:
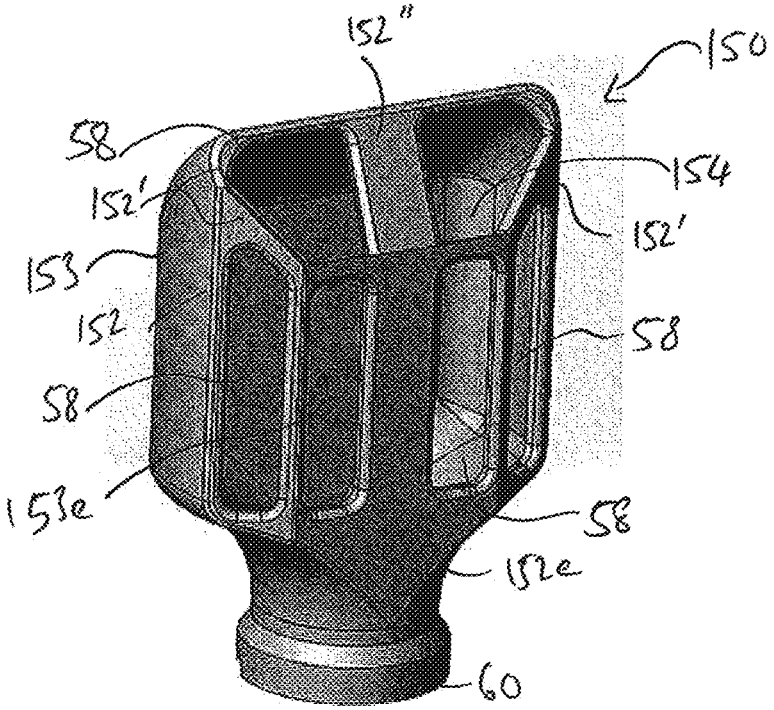
FIG. 12 shows a flow regulating device according to a further embodiment of the invention.

The flow regulating device 150 of FIG. 12 is broadly square or rectangular in profile and includes walls 152 defining flow through enclosure 154. Underside parts of walls 152 define particle inlet apertures 58 through which wash liquor and solid particulate material can enter the flow through enclosure 154. Parts of walls 152 extending above the outermost edges of the particle inlet orifices define an enclosure roof portion 153 extending over the enclosure 154 through which solid particulate material cannot pass. Portions 152', 152" of walls 152 are inclined. The inclined portions 152', 152" can have an angle of inclination such that respective portions lie parallel to a confronting inclined wall portion of the collecting volume, in particular a portions of wall 26*a*, 26*b* (and a corresponding wall opposite 26*b*, not illustrated). A base portion 152*e* can extend generally parallel to a planar part 153*e* of the enclosure roof portion. The portion 152*e* can also be arranged substantially parallel to an opposed lowermost wall of the collecting volume.

The flow regulating device 50 is disposed at, or close to, the lowermost portion of the sump 22. Thus, in operation of the apparatus 100, the flow regulating device 50 is at least partially immersed in the mass of solid particulate material which accumulates in the sump 22, and also in the wash liquor. At times the flow regulating device 50 may be wholly immersed in the mass of solid particulate material which accumulates in the sump 22, and also in the wash liquor. It will be appreciated that the mass of solid particulate material is not at all times present in the sump. For example, at some stages in the cleaning procedure effected with the apparatus 100, substantially all of the solid particulate material, or at least a major part thereof, may be in circulation within the apparatus, such as in, or being conveyed to, the drum 12. At other stages in the cleaning procedure, such as at the start or end, or when the substrate being cleaned is being spun in the drum 12 to extract wash liquor, the solid particulate material may be present in the lowest part of the sump 22, or may accumulate to form such a mass. Thus, the mass of solid particulate material is formed beneath the flow regulating device 50 and, depending on factors such as the quantity of the solid particulate material employed in the apparatus 100, the proportion of the solid particulate material which is in circulation in the apparatus 100, and the particular design or configuration of the sump, the mass of solid particulate material may at least partially surround the flow regulating device 50. However, the flow regulating device 50 prevents or limits the formation of a mass of solid particulate material in the impeller chamber 42.

In operation of the apparatus 100, for transfer of the solid particulate material from sump 22 to drum 12, pumping device 24 is turned on so that impeller 40 is caused to rotate. Wash liquor is drawn into the impeller chamber 42 through pump inlet 44 and expelled from the impeller chamber 42 through pump outlet 46. Consequently, wash liquor is drawn into the flow through enclosure 54, 154 of the flow regulating device. In the embodiment of FIGS. 4 to 8, 10, 11, 13 and 14 wash liquor can be drawn into the flow through enclosure 54 through the one or more fluid inlet orifices 56 and also through the one or more particle inlet orifices 58. The one or more fluid inlet orifices are sized to admit wash liquor to the enclosure 54 but not to admit the solid particulate material. Stated differently, the one or more fluid inlet orifices 56 are sized to be smaller than the particle size of the solid particulate material, so that the solid particulate material is too large to pass through the one or more fluid inlet orifices 56. In other embodiments the fluid inlet apertures are not present and wash liquor enters the flow through enclosure 54, 154 through the particle inlet apertures 58.

The embodiment illustrated in FIGS. 4 to 8, 10, 11, 13 and 14 can be advantageous since the flow regulating device 50 provides, via its enclosure 54 a direct and uninterrupted flow path for the wash liquor from the at least one fluid inlet orifice 56 to the enclosure outlet 60. Preferably, the flow path of the wash liquor from the at least one fluid inlet orifice 56 to the enclosure outlet 60 is substantially linear.

As noted, the wash liquor acts as a transporting fluid for the solid particulate material. For transfer of the solid particulate material from the sump 22 to the drum 12, the solid particulate material must pass through (and must be driven by) the pumping device 24. Specifically the solid particulate material passes through the impeller chamber 42. The flow regulating device 50 provides in its wall 52, 152 (such as the cylindrical wall 52*a* in the embodiment illustrated in FIGS. 4 to 8, 10, 11, 13, 14 and 15) one or more particle inlet orifices 58. In embodiments where fluid inlet orifices 56 are provided, the particle inlet orifices 58 are relatively larger than the fluid inlet orifices 56. The one or more particle inlet orifices 58 is/are provided at a lower or underside portion of the flow regulating device 50 and are not present in the enclosure roof portion. Stated differently, the one or more particle inlet orifices are configured generally to face, or be generally directed towards, the floor 32 of the sump 22, at or near the lowest portion of the sump 22.

The one or more particle inlet orifices 58 are sized to admit the solid particulate material into the flow through enclosure 54. Thus, when the pumping device 24 is in operation, solid particulate material present in the lowermost portion of the sump 22—and which is therefore proximate the flow regulating device 50—is drawn into the flow through enclosure 54 of the flow regulating device 50 through the one or more particle inlet orifices 58. Wash liquor is also drawn into the enclosure 54 through the one or more particle inlet orifices 58.

The solid particulate material drawn into the enclosure 54 is carried through the enclosure 54 with the flow of wash liquor. In this way impeller chamber 42 is presented with a mixture of the solid particulate material and the wash liquor (with the wash liquor acting as a transporting fluid). The amount of solid particulate material carried by the wash liquor through the impeller chamber is limited by the requirement for the solid particulate material to first pass into the enclosure 54 of the flow regulating device 50. An advantageous ratio of wash liquor to solid particulate material is thus obtained which deters any build-up of a mass of the solid particulate material in the impeller chamber, since the solid particulate material is carried through and out of the impeller chamber 42 by the wash liquor, acting as transporting fluid. Further, at the end of an operation period of the pumping device 24, only insignificant amounts of the solid particulate material can settle in the impeller chamber. The bulk of the solid particulate material is retained within the sump 22 since, in the absence of a flow of transporting fluid (wash liquor) through the enclosure 54, solid particulate material cannot enter the enclosure 54, and hence cannot enter the impeller chamber 42.

As noted, the one or more fluid inlet orifices 56 (when present) are sized not to admit the solid particulate material into the enclosure 54. The fluid inlet orifices 56 are configured to be of smaller size than the particle size of the solid particulate material. It is, however, possible with some relative sizes of fluid inlet orifice and solid particulate material that particles may become lodged over a given fluid inlet orifice, blocking or closing that fluid inlet orifice to the flow of wash liquor. This problem can be minimized or obviated by careful selection of the relative size and shape of the fluid inlet orifice and the size and shape of the particles of the solid particulate material. Given the wide range of possibly suitable configurations of the solid particulate material, specific sizes and shapes of orifice cannot reasonably be defined herein. However, selection of an appropriate size and shape for the fluid inlet orifice (in relation to the size and shape of a given particle of the solid particulate material) is a matter of simple experiment with the ability of a person skilled in the art. In one useful example which can address this potential problem, the at least one fluid inlet orifice 56 can be in the form of a reticulate structure, such as a net or mesh. Such a reticulate structure can be seen as including a plurality (in some cases a large plurality) of fluid inlet orifices 56. Such a reticulate structure may conveniently comprise in some embodiments a substantial part of, or substantially all of, enclosure end wall 52*b*. A fluid inlet orifice 56 may alternatively have a generally circular shape, or make take other forms, such as squares, rectangles, hexagons or other polygonal forms. A generally circular form is convenient for ease of manufacture. In other forms, a fluid inlet orifice 56 may have the shape of a slot or the like.

The one or more particle inlet orifices are present in all embodiments and are sized to admit the solid particulate material to the flow through enclosure 54. In preferred embodiments, the, or each, of the particle inlet orifices is sized to admit simultaneously a plurality of particles of the solid particulate material. The optimum size, location and number of particle inlet orifices 58 for a given apparatus according to the invention can be selected by reasonable experiment and in accordance with other apparatus parameters. The skilled person can vary the arrangement (i.e. number, location and size) of the particle inlet orifices 58 to achieve a desired ratio of transporting fluid and solid particulate material exiting the pumping device. If the arrangement of the particle inlet orifices 58 is too constrained (for example because the orifices are too small) then insufficient solid particulate material can be transferred from the sump 22 to the cleaning volume (drum 12) within a desired time period. Conversely, if the arrangement of the particle inlet orifices 58 is too generous an excess of solid particulate material may be transferred from the sump 22 and could lead to an accumulation of solid particulate material in the pumping device which could cause a blockage.

In some preferred embodiments, a plurality of the particle inlet orifices is provided, for example two or four or six or eight particle inlet orifices 58 may usefully be provided.

In some advantageous constructions, the length dimension of a given particle inlet orifice 58 can be configured to be greater than its width dimension. Preferably, in these constructions, said length dimension is about twice the width dimension. The length dimension is a dimension substantially parallel to the direction of the flow path of the wash liquor from the one or more particle inlet orifices 58 to the enclosure outlet 60 that is typically from the end wall 52*b* to the enclosure outlet 60.

A plurality of particle inlet orifices 58 may conveniently be provided in a regular arrangement at a lowermost portion of the flow regulating device 50. An equal number of particle inlet orifices may usefully be provided on respective sides of a nominally vertical plane bisecting the flow through enclosure through its longitudinal axis. For example a grid arrangement of four, six or eight (and preferably four) particle inlet orifices 58 may usefully be provided.

The inventors have found that a spine or land, being a part of enclosure wall 52*a*, 152*a*, and extending longitudinally between adjacent particle inlet orifices 58 can be advantageous. Most preferably said nominally vertical plane extends through said spine, the spine thus being located at a lowermost part of the flow through 54.

The inventors suggest that an advantage of the flow regulating device according to the present invention is that, for at least a majority of particles of the solid particulate material accumulating in the collecting region, there is no direct path for solid particulate material from the sump 22 into the pumping device 24. The flow regulating device 50 requires that the solid particulate material follows an indirect path from the sump 22 to the pumping device 24, such path including, for a majority of particles, an upwardly directed component, in particular to enter the flow through enclosure from the sump 22. Thus, the solid particulate material can pass into the flow regulating device 50 from the sump 22 (and thence into the pumping device 24) only when carried by the transporting fluid. The solid particulate material cannot enter the pumping device 24 (or can enter only in very limited amounts) merely as a consequence of settling of the solid particulate material in the sump 22, or by other factors such as vibrations caused by operation of the apparatus 100. Accumulation of the solid particulate material within the pumping device is thereby substantially prevented.

Furthermore, the flow regulating device 50 can provide a more consistent ratio of solid particulate material and transporting fluid exiting the pumping device 24. The inventors believe that this is because the amount of solid particulate material entering the enclosure 54 of the flow regulating device 50 is regulated by the requirement for the solid particulate material to pass through the particle inlet orifices 58. In contrast, in the prior art in the absence of a flow regulating device, factors such as the amount of transporting fluid in the sump and the amount of solid particulate material in the sump can have a significant effect in varying the relative amounts of solid particulate material and transporting fluid discharged from the pumping device 24. Achieving a substantially constant ratio of solid particulate material and transporting fluid on discharge from the pumping device 24 is advantageous in optimizing the cleaning process with the apparatus of the invention, since greater control of the amounts of solid particulate material and transporting fluid entering the cleaning volume (drum 12) becomes possible. An optimum quantity of solid particulate material within the cleaning volume may thus be achieved, for example. Nevertheless, the ratio of the solid particulate material and the transporting fluid may be varied by other controllable parameters such as the pump operating speed.

In further embodiments of the apparatus 100, means may be provided by which the sump 22 can be drained of the wash liquor without removing the solid particulate material from the sump. Such drain mains may be useful, for example, at the end of a cleaning procedure so that the sump can be left "dry" until the next cleaning procedure commences, which may not follow immediately. Further, drain means may be useful when it is desired to remove wash liquor so that new wash liquor can be substituted. This might, for example, occur at the end of a wash cycle when wash liquor containing detergent and/or other additives, and removed soil from the substrate being cleaned, is sent to drain and replaced with clean water. Similarly, wash liquor may be sent to drain at the end of a final or an intermediate rinse cycle.

The drain means may, in some embodiments consist of one or more drain outlet ports 62 formed in front wall 34 of the sump 22 at or near its lowermost portion. For example, the one or more drain outlet ports 62 may be formed in the front wall 34 beneath the flow regulating device 50. The drain outlet ports 62 may communicate with a drain chamber 64 which may conveniently be formed as an integral part of the pump housing and which may be conveniently arranged between the impeller chamber 42 and the sump front wall 34. The drain chamber may communicate with such pipework or tubing and pumping devices as is appropriate to send the drained wash liquor to drain. The outlet ports 62 are sized not to allow passage of solid particulate material into the drain chamber 64 and the drain chamber 64 is not in communication with the flow through enclosure 54 of the flow regulating device. Hence wash liquor can be removed from the sump without removing solid particulate material.

In further embodiments, the apparatus 100 may usefully be provided with means by which the impeller 40 of the pumping device 24 can be freed in the unlikely event that the impeller 40 becomes blocked by a build-up in the impeller chamber 42 of solid particulate material. Such unblocking means can, in embodiments, comprise an additional entry port 66 formed in the pump housing 36 in communication with the pump outlet 46. Means may be provided (such as an alternative pumping device) by which water or wash liquor may be directed through the additional entry port 66 to cause a flow of liquid through the impeller chamber 42 in the reverse direction to that which occurs when the pumping device 24 is in operation. Such reverse flow may dislodge accumulated solid particulate material and thus allow the impeller 40 to turn in its normal manner.

The cleaning volume can comprise a rotatably mounted cylindrical cage or drum 12 comprising a foraminous or perforate cylindrical wall (perforations are not shown in FIG. 1). In some embodiments up to 60% of the surface area of said side walls can comprise perforations. In some embodiments said perforations can comprise holes having a diameter of no greater than 25 mm. In some embodiments of the invention no more than 50% of the surface area of the side walls comprises perforations. In further embodiments no more than 40% of the surface area of the side walls comprises perforations. In certain embodiments of the invention, said perforations can comprise holes having a diameter of from about 2 to 25 mm. In some embodiments said perforations can comprise holes having a diameter of from about 2 to about 10 mm, in particular about 4 to about 10 mm, and in other embodiments said perforations can comprise holes having a diameter from about 5 to about 8 mm.

In some embodiments, the solid particulate material may be discharged from the drum 12 through said perforations. Generally in these embodiments the perforations in the drum can be sized at around 2-3 times the average particle diameter of a particle comprised in said solid particulate material which, in some embodiments, results in perforations having a diameter of no greater than about 10.0 mm.

In some embodiments, which may be particularly advantageous when the apparatus of the invention is a domestic washing machine, said perforations can comprise holes having a diameter of no greater than about 5 mm. In particular embodiments said perforations can comprise holes having a diameter of no greater than about 3 mm. Generally in these embodiments the perforations in the drum 12 have a size smaller than that of the particles of the solid particulate material. The perforations thus permit ingress or egress of wash liquor and such fine particulates as may be carried by the wash liquor but the solid particulate material may not exit the drum 12 through the perforations. In these embodiments, other means by which the solid particulate material may be discharged from the drum 12 may be provided.

Thus, in some embodiments the cleaning volume (drum 12) can comprise one or more collecting and transferring devices to facilitate collection of the solid particulate material and transfer of the solid particulate material to a location external to the cleaning volume (drum 12), in particular to the collecting volume (sump 22).

As noted, in some embodiments of the invention the cleaning apparatus 100 can comprise a door 18. Door 18 may be hingedly coupled to a portion of the housing 10. In certain embodiments the door 18 can be hingedly coupled or mounted on a portion of the tub 20. The door 18 can be moveable between an open and a closed position. When the door 18 is moved to an open position, access is permitted to the inside of the drum 12. When the door 18 is moved to a closed position, the cleaning apparatus 100 can be sealed. Thus, in some embodiments the cleaning apparatus 100 of the invention differs from conventional washing machines in that the door is not mounted to the external housing or cabinet but is mounted to the tub 20. Mounting the door 18 to a portion of the tub 20 and not the housing 10 can, in some embodiments, improve the sealing of the cleaning apparatus 100 when the cleaning mixture is pumped through a portion of the door 18 when the cleaning apparatus 100 is in use.

In preferred embodiments the rotatably mounted cylindrical drum or cage 12 can be mounted about an essentially horizontal axis within the housing 10. Consequently, in such embodiments of the invention, said door 18 is located in the front of the cleaning apparatus 100 thereby providing a front-loading facility.

Rotation of said rotatably mounted cylindrical cage or drum 12 can be effected by use of drive means, which typically can comprise electrical drive means, in the form of an electric motor. Operation of said drive means can be effected by control means which may be programmed by an operative.

In some embodiments the cleaning apparatus of the present invention can be a commercial washing machine. In certain embodiments said rotatably mounted cylindrical drum or cage 12 can be of the size which is to be found in most commercially available washing machines and tumble driers, and can have a capacity in the region of 10 to 7000 liters. A typical capacity for a domestic washing machine would be in the region of 30 to 150 liters whilst, for an industrial washer-extractor, capacities anywhere in the range of from 150 to 7000 liters are possible. A typical size in this range is that which is suitable for a 50 kg washload, wherein the drum has a volume of 450 to 650 liters and, in such cases, said cage (drum) 12 would generally comprise a cylinder with a diameter in the region of 75 to 120 cm, preferably from 90 to 110 cm, and a length of between 40 and 100 cm, preferably between 60 and 90 cm.

In some embodiments the cleaning apparatus 100 of the present invention can be a domestic washing machine. Typically said domestic washing machine can comprise a rotatably mounted cylindrical cage or drum 12 having a capacity of from 30 to 150 liters. In some embodiments, the rotatably mounted cylindrical drum or cage 12 can have a capacity of from 50 to 150 liters. Generally the cage or drum 12 of said domestic washing machine will be suitable for a 5 to 15 kg washload. In such embodiments, the rotatably mounted cage or drum 12 can typically comprise a cylinder with a diameter in the region of 40 to 60 cm and a length in the region of 25 cm to 60 cm. In some embodiments the cage or drum 12 can typically have 20 to 25 liters of volume per kg of washload to be cleaned.

In some embodiments the cleaning apparatus 100 of the present invention can have a length dimension of from about 40 cm to about 120 cm, a width dimension of from about 40 cm to about 100 cm and a height of from about 70 cm to about 140 cm.

In some embodiments the cleaning apparatus 100 of the present invention can have a length dimension of from about 50 cm to about 70 cm, a width dimension of from about 50 cm to about 70 cm and a height of from about 75 cm to about 95 cm. In further embodiments, the cleaning apparatus can have a length dimension of about 60 cm, a width dimension of about 60 cm and a height of from about 85 cm. In certain embodiments the cleaning apparatus of the present invention can be comparable in size to a typical front-loading domestic washing machine commonly used in the Europe.

In some embodiments cleaning apparatus 100 of the present invention can have a length dimension of from about 50 cm to about 100 cm, a width dimension of from about 40 cm to about 90 cm and a height of from about 70 cm to about 130 cm. In further embodiments can have a length dimension of from about 70 cm to about 90 cm, a width dimension of from about 50 cm to about 80 cm and a height of from about 85 cm to about 115 cm. In still further embodiments the cleaning apparatus 100 can have a length dimension of from about 77.5 cm to about 82.5 cm, a width dimension of from about 70 cm to about 75 cm and a height of from about 95 cm to about 100 cm. In yet still further embodiments the cleaning apparatus of the present invention can have a length dimension of about 71 cm (28 inches), a width dimension of about 80 cm (31.5 inches) and a height of about 96.5 cm (38 inches). In some embodiments the cleaning apparatus of the present invention can be comparable in size to a typical front-loading domestic washing machine commonly used in the USA.

The cleaning apparatus 100 of the present invention is designed to operate in conjunction with soiled substrates and cleaning media comprising a solid particulate material (also referred to as a multiplicity of solid particles), which can be in the form of a multiplicity of polymeric particles and/or a multiplicity of non-polymeric particles.

The particles of the solid particulate material can be efficiently circulated within the cleaning volume to promote effective cleaning. The cleaning volume of the cleaning apparatus 100, therefore, can include circulation means which can promote circulation of the substrate being cleaned and the solid particulate material. Thus, the inner surface of the cylindrical side walls of said rotatably mounted cylindrical cage (drum) 12 can comprise a multiplicity of spaced apart elongated protrusions affixed essentially perpendicularly to said inner surface. Typically the protrusions are aligned with the axis of rotation of cage or drum 12. In some embodiments, said protrusions can additionally comprise air amplifiers which are typically driven pneumatically and are adapted so as to promote circulation of a current of air within said drum or cage 12. Typically said cleaning apparatus 12 can comprise from 3 to 10, preferably 4, of said protrusions, which are commonly referred to as lifters.

Figure 9:
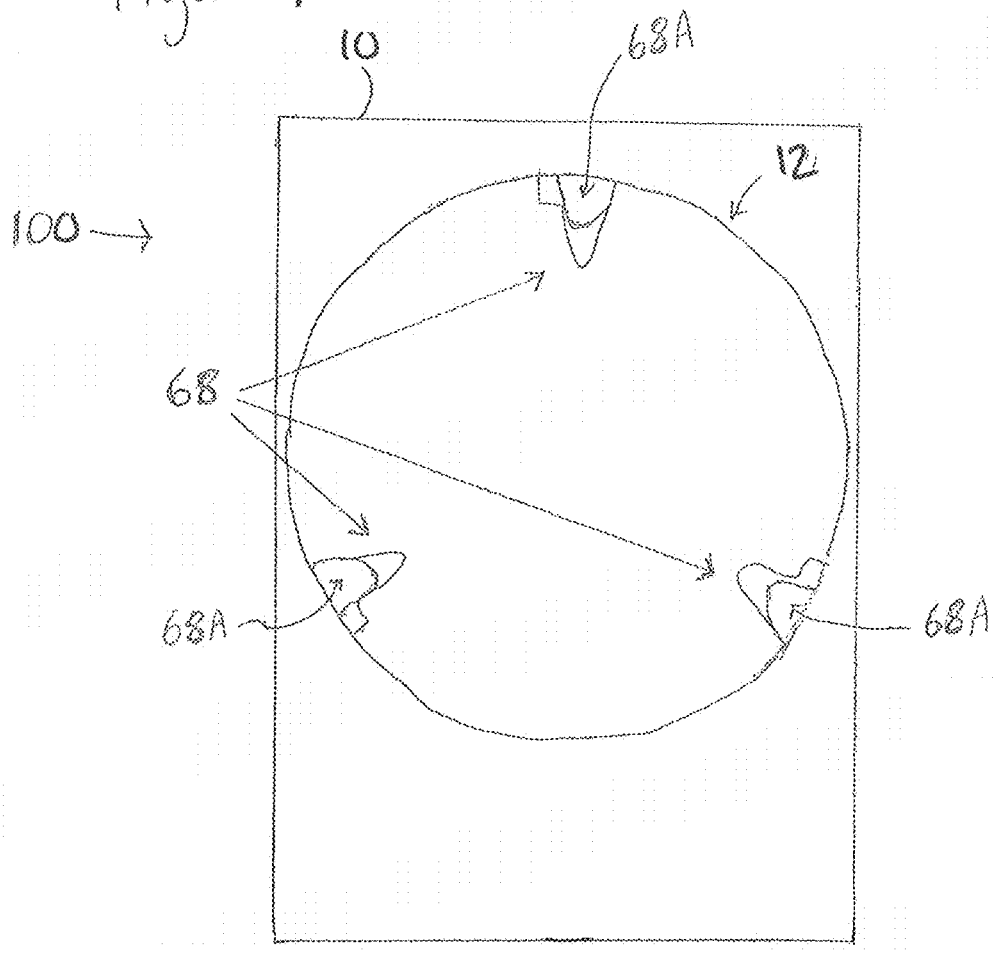
FIG. 9 is a simplified schematic section through an apparatus according to the invention illustrating collection and transfer means for the solid particulate material.

In some embodiments the cleaning apparatus 100 the lifters can function as the collecting and transferring devices for gathering solid particulate material and transferring it to the exterior of the drum 12. In particular embodiments, the lifters can collect the solid particulate material and transfer it to the collecting volume (sump 22). Referring by way of example to FIG. 9, the lifters 68 can comprise collecting and transferring devices 68A in the form of a plurality of compartments. The lifters 68 can be located at equidistant intervals on the inner circumferential surface of the rotatably mounted cylindrical drum or cage 12.

The lifters 68 can comprise a first aperture allowing ingress of solid particulate material into a capturing compartment and a second aperture allowing transfer of said solid particulate material to the exterior of drum 12. The dimensions of the apertures can be selected in line with the dimensions of the solid particulate material, so as to allow efficient ingress and transfer thereof.

In operation, agitation is provided by rotation of said rotatably mounted cylindrical cage or drum 12. However, in some embodiments of the invention, there may also be additional agitating means, in order to facilitate the efficient removal of residual solid particulate material at the conclusion of the cleaning operation. In certain embodiments, said agitating means can comprise an air jet.

In some embodiments the cleaning apparatus 100 according to the invention can comprise at least one delivery means. The delivery means can provide for the entry of wash liquor constituents (notably water and/or cleaning agents) directly (that is, otherwise than by way of the sump 22 and pumping device 24) to the rotatably mounted cylindrical cage or drum 12 as required. In further embodiments, the apparatus 100 can comprise a multiplicity of delivery means. Suitable delivery means can include, for example, one or more spraying means. The delivery means can deliver, for example, water, one or more cleaning agents or water in combination with said one or more cleaning agents. In some embodiments, the delivery means can be mounted on a portion of the door 18.

The cleaning apparatus 100 can additionally comprise means for circulating air within said housing 10 and for adjusting the temperature and humidity therein. Said means may typically include, for example, a recirculating fan, an air heater, a water atomizer and/or a steam generator. Additionally, sensing means can also be provided for determining, inter alia, the temperature and humidity levels within the cleaning apparatus 100, and for communicating this information to control means which can be worked by an operative.

In certain embodiments of the invention, the cleaning apparatus 100 can comprise a door 18 wherein the door 18 comprises a separator to separate the solid particulate material from a liquid medium and particularly wherein said liquid medium comprises wash liquor.

The cleaning apparatus 100 according to the invention is principally designed for use in the cleaning of substrates comprising textile fiber garments, linens, napery and the like, and has been shown to be particularly successful in achieving efficient cleaning of textile fibres which may, for example, comprise either natural fibres, such as cotton, wool, silk or man-made and synthetic textile fibres, for example nylon 6,6, polyester, cellulose acetate, or fiber blends thereof.

The solid particulate material for use in the apparatus and method of the invention can comprise a multiplicity of polymeric particles and/or a multiplicity of non-polymeric particles. In some embodiments, the solid particulate material can comprise a multiplicity of polymeric particles. Alternatively, the solid particulate material can comprise a mixture of polymeric particles and non-polymeric particles. In other embodiments, the solid particulate material can comprise a multiplicity of non-polymeric particles. Thus the solid particulate material in embodiments of the invention can comprise exclusively polymeric particles, exclusively non-polymeric particles or mixtures of polymeric and non-polymeric particles.

The polymeric particles or non-polymeric particles can be of such a shape and size as to allow for good flowability and intimate contact with the substrate and particularly with textile fiber. A variety of shapes of particles can be used, such as cylindrical, spherical or cuboid; appropriate cross-sectional shapes can be employed including, for example, annular ring, dog-bone and circular. In some embodiments, the particles can comprise generally cylindrical or spherical beads.

The polymeric particles or non-polymeric particles can have smooth or irregular surface structures and can be of solid, porous or hollow structure or construction.

In some embodiments the polymeric particles can be of such a size as to have an average mass of about 1 mg to about 70 mg. In certain embodiments the polymeric particles can be of such a size as to have an average mass of about 1 mg to about 50 mg. In further embodiments the polymeric particles can be of such a size as to have an average mass of about 1 mg to about 35 mg. In yet further embodiments the polymeric particles can be of such a size as to have an average mass of about 10 mg to about 30 mg. In still further embodiments the polymeric or non-polymeric particles can be of such a size as to have an average mass of about 12 mg to about 25 mg.

In some embodiments the non-polymeric particles can be of such a size as to have an average mass of about 1 mg to about 1 g. In further embodiments the non-polymeric particles can be of such a size as to have an average mass of about 10 mg to about 100 mg. In still further embodiments the non-polymeric particles can be of such a size as to have an average mass of about 25 mg to about 100 mg.

In some embodiments the polymeric or non-polymeric particles can have a surface area of 10 $mm^2$ to 120 $mm^2$. In further embodiments the polymeric or non-polymeric particles can have a surface area of 15 $mm^2$ to 50 $mm^2$. In still further embodiments the polymeric or non-polymeric particles can have a surface area of 20 $mm^2$ to 40 $mm^2$.

In some embodiments the polymeric particles can have an average density in the range of from about 0.5 to about 2.5 $g/cm^3$. In further embodiments the polymeric particles can have an average density in the range of from about 0.55 to about 2.0 $g/cm^3$. In still further embodiments the polymeric particles can have an average density in the range of from about 0.6 to about 1.9 $g/cm^3$.

In certain embodiments the non-polymeric particles can have an average density greater than the polymeric particles. Thus, in some embodiments, the non-polymeric particles can have an average density in the range of about 3.5 to about 12.0 $g/cm^3$. In still further embodiments, the non-polymeric particles can have an average density in the range of about 5.0 to about 10.0 $g/cm^3$. In yet further embodiments, the non-polymeric particles can have an average density in the range of about 6.0 to about 9.0 $g/cm^3$.

In some embodiments the average volume of the polymeric and non-polymeric particles can be in the range of 5 to 275 $mm^3$. In further embodiments the average volume of the polymeric and non-polymeric particles can be in the range of 8 to 140 $mm^3$ and in still further embodiments said average volume can be in the range of 10 to 120 $mm^3$.

In some embodiments the polymeric or non-polymeric particles can be substantially cylindrical or substantially spherical in shape.

In certain embodiments the substantially cylindrical particles can be of oval cross section. In such embodiments, the major cross section axis length, a, can be in the region of from 2.0 to 6.0 mm. In further embodiments a can be in the region of from 2.2 to 5.0 mm and in still further embodiments a can be in the region of from 2.4 mm to 4.5 mm. The minor cross section axis length, b, can be in the region of from 1.3 to 5.0 mm. In further embodiments b can be in the region of from 1.5 to 4.0 mm and in still further embodiments b can be in the region of from 1.7 mm to 3.5 mm. For an oval cross-section, a>b. In certain embodiments the length of the cylindrical particles, h, can be in the range of from about 1.5 mm to about 6 mm. In further embodiments the length h can be from about 1.7 mm to about 5.0 mm. In yet further embodiments the length h of the particle can be from about 2.0 mm to about 4.5 mm. The ratio h/b can typically be in the range of from about 0.5 to about 10.

In certain embodiments the cylindrical particles can be of circular cross section. The typical cross section diameter, $d_c$, can be in the region of from about 1.3 to about 6.0 mm. In further embodiments $d_c$ can be in the region of from about 1.5 to about 5.0 mm and in still further embodiments $d_c$ can be in the region of from about 1.7 mm to about 4.5 mm. In certain embodiments the length of such particles, $h_c$, can be in the range of from about 1.5 mm to about 6 mm. In further embodiments the length can be from about 1.7 mm to about 5.0 mm. In yet further embodiments the length of the particle can be from about 2.0 mm to about 4.5 mm. The ratio $h_c/d_c$ can typically be in the range of from about 0.5 to about 10.

In some embodiments the particles can be generally spherical in shape (but not a perfect sphere) having a particle diameter, $d_s$, in the region of from 2.0 to 8.0 mm. In further embodiments $d_s$ can be in the region of from 2.2 to 5.5 mm and in still further embodiments $d_s$ can be in the region of from about 2.4 mm to about 5.0 mm.

In certain embodiments of the invention the particles can be substantially perfectly spherical in shape having a particle diameter, $d_{ps}$, in the region of from 2.0 to 8.0 mm. In further embodiments $d_{ps}$ can be in the region of from 3.0 to 7.0 mm and in still further embodiments $d_{ps}$ can be in the region of from about 4.0 mm to about 6.5 mm.

In some embodiments the polymeric particles can comprise polyalkenes such as polyethylene and polypropylene, polyamides, polyesters, polysiloxanes or polyurethanes. Furthermore, said polymers can be linear, branched or crosslinked. In certain embodiments, said polymeric particles can comprise polyamide or polyester particles, particularly particles of nylon, polyethylene terephthalate or polybutylene terephthalate, typically in the form of beads. Said polyamides and polyesters are found to be particularly effective for aqueous stain/soil removal, whilst polyalkenes are especially useful for the removal of oil-based stains.

Various nylon homo- or co-polymers can be used including, but not limited to, Nylon 6 and Nylon 6,6. In some embodiments, the nylon can comprise Nylon 6,6 homopolymer having a molecular weight in the region of from about 5000 to about 30000 Daltons, such as from about 10000 to about 20000 Daltons, or such as from about 15000 to about 16000 Daltons. Useful polyesters can have a molecular weight corresponding to an intrinsic viscosity measurement in the range of from about 0.3 to about 1.5 dl/g, as measured by a solution technique such as ASTM D-4603.

In some embodiments the polymeric particles can comprise foamed polymers. In further embodiments the polymeric particles can comprise unfoamed polymers.

Optionally, copolymers of the above polymeric materials may be employed for the purposes of the invention. Specifically, the properties of the polymeric materials can be tailored to specific requirements by the inclusion of monomeric units which confer particular properties on the copolymer. Thus, the copolymers can be adapted to attract particular staining materials by including monomer units in the polymer chain which, inter alia, are ionically charged, or include polar moieties or unsaturated organic groups. Examples of such groups can include, for example, acid or amino groups, or salts thereof, or pendant alkenyl groups.

In some embodiments the non-polymeric particles can comprise particles of glass, silica, stone, wood, or any of a variety of metals or ceramic materials. Suitable metals include, but are not limited to, zinc, titanium, chromium, manganese, iron, cobalt, nickel, copper, tungsten, aluminum, tin and lead, and alloys thereof. Suitable ceramics include, but are not limited to, alumina, zirconia, tungsten carbide, silicon carbide and silicon nitride. In general, though, polymeric particles are preferred for textile cleaning using the apparatus of the invention.

In order to provide additional lubrication to the washing machine and thereby improve the transport properties within the system, wash liquor, which may be water, is added. Thus, more efficient transfer of cleaning agents to the substrate is facilitated, and removal of soiling and stains from the substrate occurs more readily. Optionally, the soiled substrate may be moistened by wetting with mains or tap water prior to loading into the washing machine of the invention. Wetting of the substrate to be cleaned within the apparatus of the invention is preferable. In any event, water can be added to the rotatably mounted cylindrical cage or drum 12 such that the washing treatment is carried out so as to achieve a wash liquor to substrate ratio in the drum 12 which, in some embodiments is between 5:1 and 0.1:1 w/w. In certain embodiments the wash liquor to substrate ratio is between 2.5:1 and 0.1:1 w/w. In further embodiments the ratio is between 2.0:1 and 0.8:1. By means of example, particularly favorable results have been achieved at ratios such as 1.75:1, 1.5:1, 1.2:1 and 1.1:1. Conveniently, the required amount of water can be introduced into the rotatably mounted cylindrical drum or cage 12 of the apparatus according to the invention after loading of the soiled substrate into said cage or drum.

In some embodiments the wash liquor to substrate ratio can be maintained within predetermined limits throughout the wash cycle. The predetermined limits may be different in different stages of the wash cycle. Conceivably an additional amount of wash liquor may migrate into the cage (drum) 12 during the addition of the solid particulate material such as through a separator (which may be mounted in door 18). However the amount of additional wash liquor permitted to enter the cage (drum) 12 may be regulated (and may preferably be generally minimized) due to the action of the separator. Advantageously the separator can therefore assist in maintaining a desired wash liquor to substrate ratio by limiting the entry of excess wash liquor into the cage (drum) 12 during the wash cycle.

Whilst, in some embodiments, the method of the invention envisages the cleaning of a soiled substrate by the treatment of a moistened substrate only with solid particulate material (i.e. in the absence of any further additives), optionally in other embodiments at least one cleaning agent may additionally be included. The at least one cleaning agent can include at least one detergent composition. In some embodiments said at least one cleaning agent can be mixed with said solid particulate material, for example as component of the wash liquor. In other embodiments said particles comprised in said solid particulate material can be coated with at least one cleaning agent.

The principal components of a suitable detergent composition can comprise, by way of example, cleaning components and post-treatment components. In some embodiments, the cleaning components can comprise surfactants, enzymes and bleach, whilst the post-treatment components can include, for example, anti-redeposition additives, perfumes and optical brighteners.

However, the formulation can optionally include one or more other additives such as, for example builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and/or pigments.

Examples of suitable surfactants that can be included in the detergent composition can be selected from non-ionic and/or anionic and/or cationic surfactants and/or ampholytic and/or zwitterionic and/or semi-polar non-ionic surfactants. The surfactant can typically be present at a level of from about 0.1%, from about 1%, or even from about 5% by weight of the cleaning compositions to about 99.9%, to about 80%, to about 35%, or even to about 30% by weight of the cleaning compositions.

The detergent composition can include one or more detergent enzymes which provide cleaning performance and/or fabric care benefits. Examples of suitable enzymes include, but are not limited to, hemicellulases, peroxidases, proteases, other cellulases, other xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, and amylases, or mixtures thereof. A typical combination can comprise a mixture of enzymes such as protease, lipase, cutinase and/or cellulase in conjunction with amylase.

Optionally, enzyme stabilizers can also be included amongst the cleaning components. In this regard, enzymes for use in detergents may be stabilized by various techniques, for example by the incorporation of water-soluble sources of calcium and/or magnesium ions in the compositions.

The detergent composition can include one or more bleach compounds and associated activators. Examples of such bleach compounds include, but are not limited to, peroxygen compounds, including hydrogen peroxide, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N,N'-phthaloylaminoperoxycaproic acid and amidoperoxyacid. Bleach activators include, but are not limited to, carboxylic acid esters such as tetraacetylethylenediamine and sodium nonanoyloxybenzene sulphonate.

Suitable builders can be included in the formulation and these include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyloxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

The formulation can also optionally contain one or more copper, iron and/or manganese chelating agents and/or one or more dye transfer inhibiting agents.

Suitable polymeric dye transfer inhibiting agents for use in the detergent composition include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Optionally, the detergent composition can also contain dispersants. Suitable water-soluble organic materials are the homo- or co-polymeric acids or their salts, in which the polycarboxylic acid may comprise at least two carboxyl radicals separated from each other by not more than two carbon atoms.

Said anti-redeposition additives that can be included in the detergent composition are physico-chemical in their action and include, for example, materials such as polyethylene glycol, polyacrylates and carboxy methyl cellulose.

Optionally, the detergent composition can also contain perfumes. Suitable perfumes are generally multi-component organic chemical formulations which can contain alcohols, ketones, aldehydes, esters, ethers and nitrile alkenes, and mixtures thereof. Commercially available compounds offering sufficient substantivity to provide residual fragrance include Galaxolide (1,3,4,6,7,8-hexahydro-4,6,6,7,8,8-hexamethylcyclopenta(g)-2-benzopyran), Lyral (3- and 4-(4-hydroxy-4-methyl-pentyl)cyclohexene-1-carboxaldehyde and Ambroxan ((3aR,5aS,9aS,9bR)-3a,6,6,9a-tetramethyl-2,4,5,5a,7,8,9,9b-octahydro-1H-benzo[e][1] benzofuran). One example of a commercially available fully formulated perfume is Amour Japonais supplied by Symrise® AG.

Suitable optical brighteners that can be used in the detergent composition fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds include, but are not limited to, 4,4'-bis[[6-anilino-4(methylamino)-1,3,5-triazin-2-yl]amino]stilbene-2,2'-disulphonic acid, 4,4'-bis[[6-anilino-4-[(2-hydroxyethyl)methylamino]-1,3,5-triazin-2-yl]amino]stilbene-2,2'-disulphonic acid, disodium salt, 4,4'-Bis[[2-anilino-4-[bis(2-hydroxyethyl)amino]-1,3,5-triazin-6-yl]amino]stilbene-2,2'-disulphonic acid, disodium salt, 4,4'-bis[(4,6-dianilino-1,3,5-triazin-2-yl)amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulphonic acid, disodium salt, and 2,5-bis(benzoxazol-2-yl) thiophene.

Said above components can be used either alone or in a desired combination and can be added at appropriate stages during the washing cycle in order to maximize their effects.

In some embodiments the ratio of solid particulate material to substrate is generally in the range of from about 0.1:1 to about 30:1 w/w. In certain embodiments the ratio of solid particulate material to substrate is in the range of from about 0.1:1 to about 20:1 w/w. In still further embodiments the ratio of solid particulate material to substrate is in the range of from about 0.1:1 to about 15:1 w/w and in yet further embodiments said ratio is in the range of from about 0.1:1 to about 10:1 w/w. In certain embodiments the ratio of solid particulate material to substrate is in the region of from about 0.5:1 to about 5:1 w/w. In further embodiments the ratio of solid particulate material to substrate is between about 1:1 and about 3:1 w/w and, in still further embodiments, around 2:1 w/w. Thus, for example, for the cleaning of about 5 g of fabric, about 10 g of polymeric or non-polymeric particles could be employed in one embodiment of the invention.

In some embodiments the ratio of solid particulate material to substrate can be maintained at a substantially constant level throughout the wash cycle. Consequently, pumping of fresh and recycled solid particulate material can, in some embodiments, proceed at a rate sufficient to maintain approximately the same level of solid particulate material in the rotatably mounted cylindrical cage (drum (12)) throughout the cleaning operation, and to thereby ensure that the ratio of solid particulate material to soiled substrate stays substantially constant until the wash cycle has been completed.

The apparatus and the method of the present invention can be used for either small or large scale batchwise processes and finds application in both domestic and industrial cleaning processes. In some embodiments the present invention can be applied to domestic washing machines and processes.

In a typical wash cycle using the cleaning apparatus 100 of the invention, soiled garments are first placed into the rotatably mounted cylindrical drum or cage 12. Then, an appropriate amount of wash liquor (water, together with any additional cleaning agent), can be added to said rotatably mounted cylindrical cage or drum 12 such as via the delivery means. The water can be pre-mixed with the cleaning agent prior to its introduction into the cage or drum 12. Typically, water can be added first in order to suitably wet or moisten the substrate before further introducing any cleaning agent. Optionally the water and the cleaning agent can be heated. Following the introduction of water and any optional cleaning agents, the wash cycle can commence by rotation of the drum or cage 12. The solid particulate material and (further) wash liquor residing in the sump 22, which optionally can be heated to a desired temperature, is then pumped by pumping device 24 onto a washload contained in the rotatably mounted cylindrical cage or drum 12.

During the course of agitation by rotation of the drum or cage 12 wash liquor (including any cleaning agents) and a quantity of the solid particulate material (i.e. the cleaning media) exit the cage 12 and pass into the sump 22. The sloping floor 32 directs the solid particulate material and wash liquor towards the lowest region of the sump 22. From the sump 22, the pumping device 24 again pumps wash liquor in combination with the solid particulate material via ducting into the cage or drum 12 as required during the wash cycle. Furthermore, solid particulate material used in the cleaning operation which exits the cage or drum 12 and returns to the sump 22 can be reintroduced into the cage or drum 12 and can therefore be re-used in either a single wash cycle or subsequent wash cycles. Wash liquor pumped from the sump 22 can be separated, by a separator, from the solid particulate material and any wash liquor which therefore does not enter the rotatably mounted drum or cage 12 can be returned to the sump 22 via a suitable drain.

The cleaning apparatus 100 can perform a wash cycle in a similar manner to a standard washing machine with the drum or cage 12 typically rotating at between about 30 and about 40 rpm for several revolutions in one direction, then rotating a similar number of rotations in the opposite direction. This sequence can be repeated for up to about 60 minutes, by way of example. During this period, solid particulate material can be introduced and reintroduced to the drum or cage 12 from the sump 22 in the manner as described above.

As previously noted, the apparatus and method of the invention can find particular application in the cleaning of textile fibres. The conditions employed in such a cleaning system do, however, allow the use of significantly reduced temperatures from those which typically apply to the conventional wet cleaning of textile fabrics and, as a consequence, offer significant environmental and economic benefits. Thus, typical procedures and conditions for the wash cycle require that fabrics are generally treated according to the method of the invention at, for example, temperatures of between 5 and 95° C. for a duration of between about 5 and 120 minutes in a substantially sealed system. Thereafter, additional time is required for the completion of the rinsing and any further stages of the overall process, so that the total duration of the entire cycle is typically in the region of about 1 hour. The operating temperatures for the method of the invention can be in the range of from about 10 to about 60° C. and, in some embodiments, from about 15 to about 40° C.

The results obtained when cleaning with the apparatus of the invention are very much in line with those observed when carrying out conventional wet (or dry) cleaning procedures with textile fabrics. The extent of cleaning and stain removal achieved with fabrics treated by the method of the invention is seen to be very good, with particularly outstanding results being achieved in respect of hydrophobic stains and aqueous stains and soiling, which are often difficult to remove. The energy requirement, the total volume of water used, and the detergent consumption when using the washing machine of the invention are all significantly lower than those levels associated with the use of conventional aqueous washing procedures, again offering significant advantages in terms of cost and environmental benefits.

The benefits of the flow regulating device will now be illustrated by the following experimental section.

Figure 7:
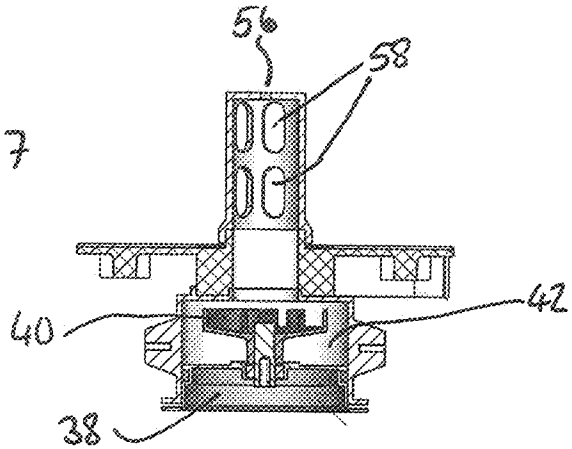
FIG. 7 is a section along the line Y-Y of FIG. 5.
Figure 5:
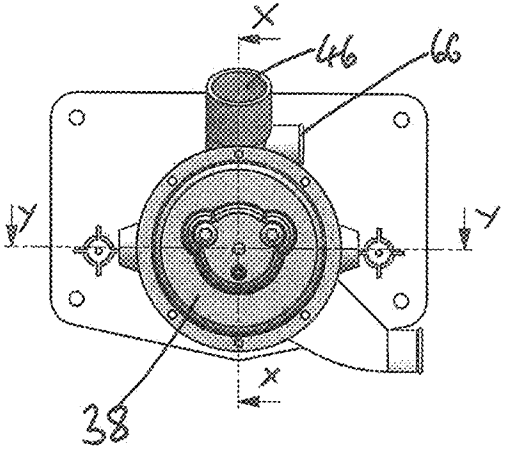
FIG. 5 is an end view of a pumping device and associated housing suitable for an apparatus according to the invention.

An apparatus was constructed to quantify the benefits of the flow regulating device as used in the present invention. The apparatus comprised a collecting volume connected to a pump via a pump inlet near the base of the collecting volume. The apparatus also comprised a circulation pathway in the form of a pipe running from the pump back into the collecting volume at higher level. Pumping experiments were then performed with the flow regulating device as shown in FIG. 7 (Experiment 1) and without any flow regulating device (Comparative Experiment 1). In all experiments the apparatus contained 6 kg of water and 5 kg of polymer beads having a particle size of about 4-5 mm. A high weight ratio of beads to water was chosen so as to make pump blockages particularly problematic. This reflects a particularly stringent test.

Comparative Experiment 1 (without Flow Regulating Device)

The pump was switched on and the collecting volume was allowed to run low of water; this happened after approximately 2 seconds of pumping. At this time the pump halted due to low water levels.

Next the pump was switched off to allow water to drain back in to the collecting volume which took approximately 5 seconds.

The pump was switched on a second time this time the pump was unable to pump the beads and water mix which subsequently blocked the pump. The only way to restart the pump was by disassembling the pump and freeing the pump mechanism of the beads.

Experiment 1 (with Flow Regulating Device)

The pump was switched on and the collecting volume was allowed to run low of water, this happened after approximately 3 seconds of pumping. At this time the pump halted because of low water levels.

The pump was switched off to allow water to drain back in to collecting volume which took approximately 5 seconds.

The pump was switched on a second time for approximately 3 seconds before running low of water and no longer pumping. The pump could readily be restarted without any intervention or unblocking.

The pump was switched on 5 more times for 3 seconds of pumping with the 5 seconds for water to drain back. In every instance the pump could successfully be restarting without intervention or unblocking.

Accordingly, the benefits of the flow regulating device as used in the apparatus of the present invention were clearly demonstrated.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. Apparatus for cleaning a soiled substrate using solid particulate material, the apparatus comprising:

a cleaning volume;

a collecting volume in which solid particulate material can accumulate from the cleaning volume;

a pumping device having a pump inlet;

a circulation pathway by which solid particulate material and transporting fluid can be transferred from the collecting volume to the cleaning volume via the pumping device; and a flow regulating device disposed in the collecting volume and comprising a flow through enclosure defined by at least one wall, an enclosure outlet in communication with the pump inlet, at least one particle inlet orifice disposed at an underside of the flow through enclosure and configured to admit from the collecting volume both solid particulate material and transporting fluid to the flow through enclosure and an enclosure roof portion of at least one of the at least one walls through which solid particulate material cannot be admitted to the flow through enclosure;

wherein the flow regulating device is configured such that to enter the flow through enclosure, solid particulate material follows a path having an upwardly directed component; and wherein the flow regulating device comprises at least one fluid inlet orifice configured only to admit transporting fluid to the flow through enclosure.

2. The apparatus as claimed in claim 1, wherein the enclosure roof portion extends over at least the whole width and length of the flow through enclosure.

3. The apparatus as claimed in claim 1, wherein the enclosure roof portion includes at least one of the at least one fluid inlet orifices configured only to admit transporting fluid to the flow through enclosure.

4. The apparatus as claimed in claim 1, wherein the apparatus is selected from the group consisting of a commercial washing machine and a domestic washing machine.

5. The apparatus as claimed in claim 1, wherein the collecting volume is arranged below the cleaning volume.

6. The apparatus as claimed in claim 1, wherein the cleaning volume comprises a perforate drum configured for rotation about a substantially horizontal axis.

7. The apparatus as claimed in claim 6, wherein the collecting volume is arranged directly below the perforate drum.

8. The apparatus as claimed in claim 1, wherein the collecting volume includes a collecting region at a lowermost portion thereof proximate the pumping device in which collecting region solid particulate material can accumulate and wherein the flow regulating device is arranged in the collecting region.

9. The apparatus as claimed in claim 8, wherein the collecting volume comprises at least one inclined wall configured to direct solid particulate material to the collecting region of the collecting volume.

10. The apparatus as claimed in claim 1, wherein the flow regulating device comprises an end wall arranged opposite the enclosure outlet, at least one of the at least one fluid inlet orifices being formed in the end wall such that transporting fluid passing through the at least one of the at least one fluid inlet orifices has a substantially linear flow path from the at least one of the at least one fluid inlet orifices to the enclosure outlet.

11. The apparatus as claimed in claim 1, wherein at least one of the at least one particle inlet orifices has a length which is greater than its width.

12. The apparatus as claimed in claim 1 comprising at least two particle inlet orifices.

13. The apparatus as claimed in claim 1 comprising at least four particle inlet orifices.

14. The apparatus as claimed in claim 1, wherein the flow regulating device is substantially cylindrical.

15. The apparatus as claimed in claim 1, wherein solid particulate material is a polymeric material.

16. The apparatus as claimed in claim 1, wherein transporting fluid is water.

17. The apparatus as claimed in claim 1, wherein transporting fluid is washing liquor.

18. The apparatus as claimed in claim 1, wherein the soiled substrate is a textile material.

19. A method for cleaning a soiled substrate comprising treating in an apparatus according to claim 1 of the substrate with a formulation comprising solid particulate material and a wash liquor.

20. The method as claimed in claim 19 further comprising circulating solid particulate material from the collecting volume to the cleaning volume along the circulation pathway.

* * * * *